US012471714B2

(12) United States Patent
Grabinger et al.

(10) Patent No.: US 12,471,714 B2
(45) Date of Patent: Nov. 18, 2025

(54) MODULAR AIR CONTROL SYSTEM FOR BED

(71) Applicant: Sleep Number Corporation, Minneapolis, MN (US)

(72) Inventors: Cory Lee Grabinger, Maple Grove, MN (US); Matthew Griffith, Buffalo, MN (US)

(73) Assignee: Sleep Number Corporation, Minneapolis, MN (US)

( * ) Notice: Subject to any disclaimer, the term of this patent is extended or adjusted under 35 U.S.C. 154(b) by 630 days.

(21) Appl. No.: 17/890,697

(22) Filed: Aug. 18, 2022

(65) Prior Publication Data

US 2023/0063576 A1 Mar. 2, 2023

Related U.S. Application Data

(60) Provisional application No. 63/236,813, filed on Aug. 25, 2021.

(51) Int. Cl.
*A47C 21/04* (2006.01)

(52) U.S. Cl.
CPC ..... *A47C 21/044* (2013.01); *A47C 21/048* (2013.01)

(58) Field of Classification Search
CPC ... A47C 21/044; A47C 21/048; A47C 27/142; A61G 7/05784; F16B 9/07; F16B 37/043
See application file for complete search history.

(56) References Cited

U.S. PATENT DOCUMENTS

| | | | |
|---|---|---|---|
| 7,877,827 | B2 | 2/2011 | Comiskey et al. |
| 7,996,936 | B2 | 8/2011 | Comiskey et al. |
| 8,065,763 | B2 | 11/2011 | Brykalski et al. |
| 8,181,290 | B2 | 5/2012 | Brykalski et al. |

(Continued)

FOREIGN PATENT DOCUMENTS

GB 2550198 A * 11/2017 ..... A47C 21/044

OTHER PUBLICATIONS

International Preliminary Report on Patentability in International Appln. No. PCT/US2022/040750, mailed on Mar. 7, 2024, 12 pages.

(Continued)

*Primary Examiner* — Matthew Troutman
*Assistant Examiner* — Alison N Labarge
(74) *Attorney, Agent, or Firm* — Fish & Richardson P.C.

(57) ABSTRACT

Described herein is a bed system having a foundation with first and second foundation sides and a support surface that can support a mattress on the first foundation side and defining a foundation aperture extending between the first and second foundation sides, an air controller having an outlet to cause air to flow out of the air controller through the outlet, and a controller retainer fixed to the foundation proximate to the foundation aperture. The controller retainer can include a toolless connection interface exposed at the second foundation side and can detachably couple with the air controller at the second foundation side. The controller retainer can, based on the air controller being coupled to the controller retainer, align the outlet of the air controller with the foundation aperture to direct air from the air controller through the foundation aperture to the mattress positioned on the support surface of the foundation.

20 Claims, 15 Drawing Sheets

(56) References Cited

U.S. PATENT DOCUMENTS

| | | | |
|---|---|---|---|
| 8,191,187 | B2 | 6/2012 | Brykalski et al. |
| 8,332,975 | B2 | 12/2012 | Brykalski et al. |
| 8,402,579 | B2 | 3/2013 | Comiskey et al. |
| 8,418,286 | B2 | 4/2013 | Brykalski et al. |
| 8,621,687 | B2 | 1/2014 | Brykalski et al. |
| 8,732,874 | B2 | 5/2014 | Brykalski et al. |
| 8,782,830 | B2 | 7/2014 | Brykalski et al. |
| 8,893,329 | B2 | 11/2014 | Petrovski et al. |
| 9,125,497 | B2 | 9/2015 | Brykalski et al. |
| 9,131,781 | B2 | 9/2015 | Zaiss et al. |
| 9,603,459 | B2 | 3/2017 | Brykalski et al. |
| 9,622,588 | B2 | 4/2017 | Brykalski et al. |
| 9,814,641 | B2 | 11/2017 | Brykalski et al. |
| 9,974,394 | B2 | 5/2018 | Brykalski et al. |
| 10,194,752 | B2 | 2/2019 | Zaiss et al. |
| 10,226,134 | B2 | 3/2019 | Brykalski et al. |
| 10,405,667 | B2 | 9/2019 | Comiskey et al. |
| 10,675,198 | B2 | 6/2020 | Brykalski et al. |
| 10,772,438 | B2 | 9/2020 | Griffith et al. |
| 11,020,298 | B2 | 6/2021 | Brykalski et al. |
| 11,045,371 | B2 | 6/2021 | Brykalski et al. |
| 11,083,308 | B2 | 8/2021 | Zaiss et al. |
| 11,297,953 | B2 | 4/2022 | Brykalski et al. |
| 2014/0026320 | A1 | 1/2014 | Comiskey et al. |
| 2014/0060878 | A1* | 3/2014 | Trojanowski ..... H02G 3/14 29/428 |
| 2015/0238020 | A1 | 8/2015 | Petrovski et al. |
| 2016/0066701 | A1 | 3/2016 | Diller et al. |
| 2016/0245328 | A1* | 8/2016 | Arisa Busquets .... F16B 37/043 |
| 2017/0071359 | A1 | 3/2017 | Steele et al. |
| 2017/0196367 | A1* | 7/2017 | Aramli ..... F16L 3/13 |
| 2017/0273470 | A1 | 9/2017 | Brykalski et al. |
| 2017/0280883 | A1 | 10/2017 | Diller |
| 2018/0027981 | A1* | 2/2018 | Sherman ..... A47C 21/044 |
| 2020/0000242 | A1* | 1/2020 | Ermalovich ..... F04D 29/601 |
| 2020/0337470 | A1 | 10/2020 | Sayadi et al. |
| 2021/0037987 | A1 | 2/2021 | Griffith et al. |
| 2021/0038453 | A1 | 2/2021 | Brykalski et al. |
| 2021/0204706 | A1 | 7/2021 | Karschnik et al. |
| 2021/0204709 | A1 | 7/2021 | Grabinger et al. |
| 2021/0204710 | A1 | 7/2021 | Grabinger et al. |
| 2021/0204711 | A1 | 7/2021 | Karschnik et al. |
| 2021/0204712 | A1 | 7/2021 | Karschnik et al. |
| 2021/0204713 | A1 | 7/2021 | Karschnik et al. |
| 2021/0204714 | A1 | 7/2021 | Karschnik et al. |
| 2021/0204715 | A1 | 7/2021 | Karschnik et al. |
| 2021/0204716 | A1 | 7/2021 | Karschnik et al. |
| 2021/0204719 | A1 | 7/2021 | Grabinger et al. |
| 2021/0204720 | A1 | 7/2021 | Karschnik et al. |
| 2021/0322237 | A1 | 10/2021 | Brykalski et al. |
| 2021/0322238 | A1 | 10/2021 | Brykalski et al. |
| 2021/0401185 | A1 | 12/2021 | Zaiss et al. |
| 2022/0232990 | A1 | 7/2022 | Brykalski et al. |
| 2022/0261020 | A1 | 8/2022 | Molina et al. |
| 2022/0273115 | A1 | 9/2022 | Pedersen et al. |
| 2022/0287473 | A1 | 9/2022 | Karschnik et al. |

OTHER PUBLICATIONS

U.S. Appl. No. 15/685,912, filed Aug. 24, 2017, Petrovski et al.
U.S. Appl. No. 15/973,279, filed May 7, 2018, Brykalski et al.
U.S. Appl. No. 17/890,677, filed Aug. 18, 2022, Karschnik et al.
U.S. Appl. No. 17/964,150, filed Oct. 12, 2022, Grabinger et al.
U.S. Appl. No. 17/982,730, filed Nov. 8, 2022, Karschnik et al.
U.S. Appl. No. 18/091,765, filed Dec. 30, 2022, Brykalski et al.
International Search Report and Written Opinion in International Appln. No. PCT/US2022/040750, mailed on Feb. 2, 2023, 19 pages.
Invitation to Pay Additional Fees and, Where Applicable, Protest Fee in International Appln. No. PCT/US2022/040750, mailed on Dec. 8, 2022, 13 pages.

* cited by examiner

MODULAR AIR CONTROL SYSTEM FOR BED

CROSS-REFERENCE TO RELATED APPLICATIONS

This application claims priority to U.S. Provisional Application Ser. No. 63/236,813, filed on Aug. 25, 2021, the disclosure of which is incorporated by reference in its entirety.

TECHNICAL FIELD

This document describes modular air control devices and systems for beds, and methods for providing such air control devices and systems to beds.

BACKGROUND

In general, a bed is a piece of furniture used as a location to sleep or relax. Many modern beds include a soft mattress on a foundation. The mattress may include springs, foam material, and/or an air chamber to support the weight of one or more occupants. Various features and systems have been used in conjunction with beds, including air control devices and systems for controlling a microclimate of a bed. For example, a heating and/or cooling system can be provided for heating and/or cooling air at or around a top of a mattress so as to provide a desire temperature to a user on the mattress.

SUMMARY

The document generally relates to a modular air controller configured to control a microclimate of a bed. The air controller, for example, can supply ambient or conditioned air toward a top of the bed, or draw air from the top of the bed, thereby controlling a temperature and/or humidity at the top of the bed. More specifically, the document relates to a modular air controller (e.g., thermal engine) that can allow for easy installation and/or replacement of the air controller. An air controller (e.g., electromechanical thermal engine) as described herein can be installed into a bed base or foundation without use of tools. The air controller can also be easily removed from the bed base using average or household tools. In alternative implementations, the air controller can be removed from the bed base without using a tool. Special tools are not required to install the air controller to the bed base or remove the air controller from the bed base. The air controller can be easily maintained or repaired because it is easily detachable. Further, the air controller can be easily replaced by another air controller (e.g., an air controller of the same type or model, or an air controller of a different type or model). For example, an air controller can be easily replaced by another one having one or more different features or capabilities. In particular, the air controller can include one or more features, such as, for example, heating and cooling capabilities, only heating, only cooling, humidity sensing, and no humidity sensing. In some implementations, the air controller can include a combination of any one or more of such features. With the coupling configurations described herein, the user can easily and quickly swap out air controllers having different features based on the user's preferences and/or desires.

The disclosed modular coupling mechanisms for coupling the air controller to a bed can be implemented in various configurations. For example, the mechanisms can include a slide on, snap on, or cartridge-style attachment from a mechanical interface standpoint. The disclosed modular coupling mechanisms can be implemented to allow the air controller to be attached to the foundation (e.g., bed base) of a bed and configured to communicate with one or more other components of the bed, including one or more components of the mattress. The disclosed modular coupling mechanisms can also incorporate integrated wire connectors that allow the components in the air controller to be electrically connected to corresponding components of the bed, as the air controller is attached to the foundation. Alternatively, the disclosed modular coupling mechanisms can allow the air controller to have wire connectors that are separate from wire connectors used by one or more other components of the bed. In this case, the wire connectors of the air controller can be manually connected to the corresponding wire connectors of the bed components, when the air controller is coupled to the foundation using the disclosed modular coupling mechanisms.

In some implementations, a retainer is provided to releasably couple the air controller at a bottom of the foundation. The retainer can couple the air controller to the foundation such that an outlet or air vent of the air controller can be aligned with a foundation aperture that can be in fluid communication with an air duct hose extending from a mattress resting on the foundation. The air controller can cause air to flow out of the air controller through the outlet or air vent. The foundation aperture can extend between first and second sides of the foundation, such as a top surface and a bottom surface that is opposite the top surface of the foundation. The retainer can be fixed to the foundation proximate to the foundation aperture. In some implementations, the retainer can include a toolless connection interface. The toolless connection interface can be positioned at least partially at the top surface of the foundation and can detachably couple with the air controller at the bottom surface of the foundation. When the air controller is coupled to the retainer, the outlet or air vent of the air controller can be aligned with the foundation aperture to direct air from the air controller through the foundation aperture. The air can flow to the mattress positioned on the top surface of the foundation. In some implementations, the air duct hose of the mattress can couple to the air controller through the retainer. For example, the retainer provides a hose connection interface that can couple the air duct hose extending from the mattress. Alternatively, the air duct hose of the mattress can couple directly to the air controller without attachment to the retainer.

In some implementations, the air controller can be coupled to the controller retainer at a lower side of the foundation, such as the bottom surface of the foundation. The air controller can be coupled to the retainer by inserting an engagement flange of the air controller into a slit of the controller retainer. The retainer can also include a locking tab that can extend away from a bottom surface of the toolless connection interface. The locking tab can have a snapping end that can engage with an engagement portion of the air controller to couple the air controller to the retainer.

Particular embodiments described herein include a bed system having a foundation, an air controller, and a controller retainer. The foundation can have a first foundation side and a second foundation side, the foundation having a support surface that can support a mattress on the first foundation side and defining a foundation aperture extending between the first foundation side and the second foundation side. The air controller can have an outlet and the air controller can cause air to flow out of the air controller through the outlet. The controller retainer can be fixed to the foundation proximate to the foundation aperture. The controller retainer can include a toolless connection interface exposed at the second foundation side and can detachably couple with the air controller at the second foundation side. The controller retainer can, based on the air controller being coupled to the controller retainer, align the outlet of the air controller with the foundation aperture to direct air from the air controller through the foundation aperture to the mattress positioned on the support surface of the foundation.

In some implementations, the system can optionally include one or more of the following features. For example, the air controller can include an engagement flange, and the toolless connection interface can include a slit defined at a first portion of the controller retainer that can receive the engagement flange of the air controller to thereby couple the air controller to the controller retainer. In some implementations, the air controller can define an air vent through which air flows into or out of the air controller, and the engagement flange of the air controller can extend away from the air vent. In yet some implementations, the toolless connection interface can include a locking tab at a second portion of the controller retainer, the locking tab extending away from the second foundation side and including a snapping end that can engage with an engagement portion of the air controller to thereby couple the air controller to the controller retainer. In some implementations, the locking tab can engage with a tool, and the locking tab can, based on the tool being engaged with the locking tab, flex to thereby disengage the snapping end of the locking tab from the engagement portion of the air controller. As another example, the first portion of the controller retainer can be located to be opposite to the second portion of the controller retainer relative to the opening of the controller retainer.

As another example, the toolless connection interface of the controller retainer can couple the air controller without using a tool for fastening the air controller to the foundation. The air controller can define a housing and the controller retainer can detachably couple with the housing of the air controller at the second foundation side. The mattress can include an air distribution layer and an air duct can be in fluid communication with the air distribution layer. In some implementations, the outlet of the air controller can cause air to flow out of the air controller through the air duct.

As yet another example, the controller retainer can define an opening that can be aligned with the foundation aperture. The opening of the controller retainer can, based on the air controller being coupled to the controller retainer, be in fluid communication with the air controller.

In some implementations, the air controller can include a pivot bar, and the toolless connection interface can include a receiving cup at a first portion of the controller retainer that can receive the pivot bar of the air controller to thereby couple the air controller to the controller retainer. In some implementations, the toolless connection interface can include a first attachment plate and a second attachment plate, and the second attachment plate can include (i) a receiving cup at a first portion of the second attachment plate that can receive a pivot bar of the air controller and (ii) a locking tab at a bottom surface of the second attachment plate that can engage with an engagement portion of the air controller. Sometimes, the first attachment plate can include engagement connectors along a perimeter of a bottom surface of the first attachment plate that can snap fit into corresponding receivers along a perimeter of a top surface of the second attachment plate, thereby coupling the first attachment plate to the second attachment plate. Moreover, the first attachment plate can be placed at a top surface of the foundation and the second attachment plate can be placed at a bottom surface of the foundation. In yet some implementations, the first attachment plate can include first and second apertures on opposing sides of a top surface of the first attachment plate that can receive first and second locking tabs of a plenum.

Particular embodiments described herein can include a method for assembling a bed, the method including fixing a controller retainer to a foundation, and coupling an air controller to the controller retainer at a lower side of the foundation by inserting an engagement flange of the air controller into a slit of the controller retainer in a first direction, and based on the engagement flange of the air controller being inserted in the slit of the controller retainer, engaging a locking tab of the controller retainer with an engagement portion of the air controller.

In some implementations, the method can optionally include one or more of the following features. Fixing the controller to the foundation can include fixing the controller retainer at an upper side of the foundation. Engaging the locking tab of the controller retainer with the engagement portion of the air controller can include based on the engagement flange of the air controller being inserted in the slit of the controller retainer, moving the air controller toward the controller retainer until a snapping end of the locking tab engages with the engagement portion of the air controller. In some implementations, engaging the locking tab of the controller retainer with the engagement portion of the air controller can include based on the engagement flange of the air controller being inserted in the slit of the controller retainer, moving the controller retainer toward the air controller until the snapping end of the locking tab engages with the engagement portion of the air controller.

In some implementations, the method can further include positioning a mattress at an upper side of the foundation, and coupling an air duct to the controller retainer at the upper side of the foundation, the air duct extending from an air distribution layer of the mattress. The first direction can be perpendicular to the second direction. Moreover, the first direction can be parallel with the lower side of the foundation, and the second direction can be perpendicular to the lower side of the foundation in some implementations.

As another example, the method can also include flexing the locking tab of the controller retainer by engaging a tool between the locking tab of the controller retainer and the engagement portion of the air controller, moving the air controller away from the controller retainer in a third direction until the snapping end of the flexed locking tab disengages from the engagement portion of the air controller, the third direction being opposite the second direction, and removing the engagement flange of the air controller from the slit of the controller retainer in a fourth direction, the fourth direction being opposite the first direction.

As yet another example, the method can also include flexing the locking tab of the controller retainer by engaging a tool between the locking tab of the controller retainer and the engagement portion of the air controller, moving the controller retainer away from the air controller in a third direction until the snapping end of the flexed locking tab disengages from the engagement portion of the air controller, the third direction being opposite the second direction, and removing the engagement flange of the air controller from the slit of the controller retainer in a fourth direction, the fourth direction being opposite the first direction. Moreover, in some implementations, the controller retainer can define an opening that is configured to be aligned with a foundation aperture defined at the foundation.

Particular embodiments described herein can include a bed air controller retainer that can attach an air controller at a foundation, the bed air controller retainer having a retainer body and a toolless connection interface. The retainer body can be fixed at a first foundation side of the foundation and defining an opening that can be aligned with a foundation aperture being defined at the foundation. The toolless connection interface can detachably couple with an air controller at a bottom of the retainer body. The toolless connection interface can include a slit defined at a first portion of the retainer body that can receive an engagement flange of the air controller, and a locking tab at a second portion of the retainer body. The locking tab can extend away from the bottom of the retainer body and can include a snapping end that can engage with an engagement portion of the air controller to thereby couple the air controller to the controller retainer.

In some implementations, the bed air controller retainer can optionally include one or more of the following features. The locking tab can engage with a tool, and the locking tab can, based on the tool being engaged with the locking tab, flex to thereby disengage the snapping end of the locking tab from the engagement portion of the air controller. As another example, the first portion of the controller retainer can be located to be opposite to the second portion of the controller retainer relative to the opening of the controller retainer. Moreover, the toolless connection interface of the controller retainer can couple the air controller without using a tool for fastening the air controller to the foundation. In some implementations, the toolless connection interface can at least partially be exposed at a second foundation side and can detachably couple with the air controller at the second foundation side. As another example, the locking tab can extend away from the second foundation side.

Particular embodiments described herein can also include a bed system having a foundation, an air controller, and a controller retainer. The foundation can have a first foundation side and a second foundation side, the foundation having a support surface that can support a mattress on the first foundation side. The air controller can define an air vent through which air can flow into or out of the air controller and can include an engagement flange that can extend away from the air vent. The air controller can cause air to flow out of the air controller through the air vent. The controller retainer can be fixed to the foundation and can include a toolless connection interface, a slit, and a locking tab. The toolless connection interface can at least partially be positioned at the second foundation side and can detachably couple with the air controller at the second foundation side. The slit can be defined at a first portion of the controller retainer and can receive the engagement flange of the air controller. The locking tab can be at a second portion of the controller retainer, can extend away from the second foundation side, and can include a snapping end that can engage with an engagement portion of the air controller to thereby couple the air controller to the controller retainer.

In some implementations, the bed system can optionally include one or more of the following features. The opening of the controller retainer can, based on the air controller being coupled to the controller retainer, be in fluid communication with the air controller. The locking tab can engage with a tool, and the locking tab can, based on the tool being engaged with the locking tab, flex to thereby disengage the snapping end of the locking tab from the engagement portion of the air controller. In some implementations, the first portion of the controller retainer can be located to be opposite to the second portion of the controller retainer relative to the opening of the controller retainer. In some implementations, the toolless connection interface of the controller retainer can couple the air controller without using a tool for fastening the air controller to the foundation. In yet some implementations, the mattress can include an air distribution layer and an air duct can be in fluid communication with the air distribution layer. As another example, the foundation can define a foundation aperture extending between the first foundation side and the second foundation side. Moreover, the controller retainer can include an opening that can be aligned with the foundation aperture. In yet some implementations, the locking tab can extend away from the second foundation side.

Particular embodiments described herein can also include a bed system having a foundation, an air controller, and a controller retainer. The foundation can have a first foundation side and a second foundation side, the foundation having a support surface that can support a mattress on the first foundation side and defining a foundation aperture extending between the first foundation side and the second foundation side. The air controller can have an outlet and a coupling protrusion, and the air controller can cause air to flow out of the air controller through the outlet. The controller retainer can include a first attachment plate placed at the first foundation side, and a second attachment plate placed at the second foundation side and including (i) a coupling receiver at a first portion of the second attachment plate that can receive the coupling protrusion of the air controller and (ii) a locking tab at a bottom surface of the second attachment plate that can engage with an engagement portion of the air controller. The controller retainer can, based on the air controller being coupled to the controller retainer, align the outlet of the air controller with the foundation aperture to direct air from the air controller through the foundation aperture to the mattress positioned on the support surface of the foundation.

In some implementations, the bed system can optionally include one or more of the following features. The first attachment plate can include first and second apertures on opposing sides of a top surface of the first attachment plate that can receive first and second locking tabs of a plenum. In some implementations, the first attachment plate can include engagement connectors along a perimeter of a bottom surface of the first attachment plate, and the second attachment plate can include receivers that can snap fit the engagement connectors of the first attachment plate, and the first attachment plate placed at the first foundation side can be connected to the second attachment plate placed at the second foundation side with the engagement connectors of the first attachment plate snap-fitting the receivers of the second attachment plate at the foundation aperture defined through the foundation.

The devices, system, and techniques described herein may provide one or more of the following advantages. For example, the air controllers (e.g., thermal engines) described herein can be installed and removed without fasteners, external clips, or other general or special tools while still meeting third party safety requirements that require some sort of tool to be used to remove the air controllers. To remove the air controllers described herein, the user can use any household item having a long, flat end or point, such as a butter knife, a flathead screwdriver, etc. Such a household item can be used as the tool to disengage the air controllers from components of the bed. This can make it easier and faster for the user to install and remove the air controllers.

Moreover, special tools are not required to for installation and removal of the air controllers described herein. Ease and intuitiveness of installation can reduce possibility of partial installations or mis-installations. Any user can make an installation themselves, without assistance from a professional or the use of special tools.

As another example, the disclosed air controllers provide for fastener-free installation, which means the air controllers can be deployed rapidly and cost effectively. Fasteners are not required to retain the air controllers to the bed. Moreover, the air controllers can be rapidly swapped in the event that the user desires to install a different air controller to upgrade or change capabilities of the air controller or an installed air controller requires maintenance.

The details of one or more implementations are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1:
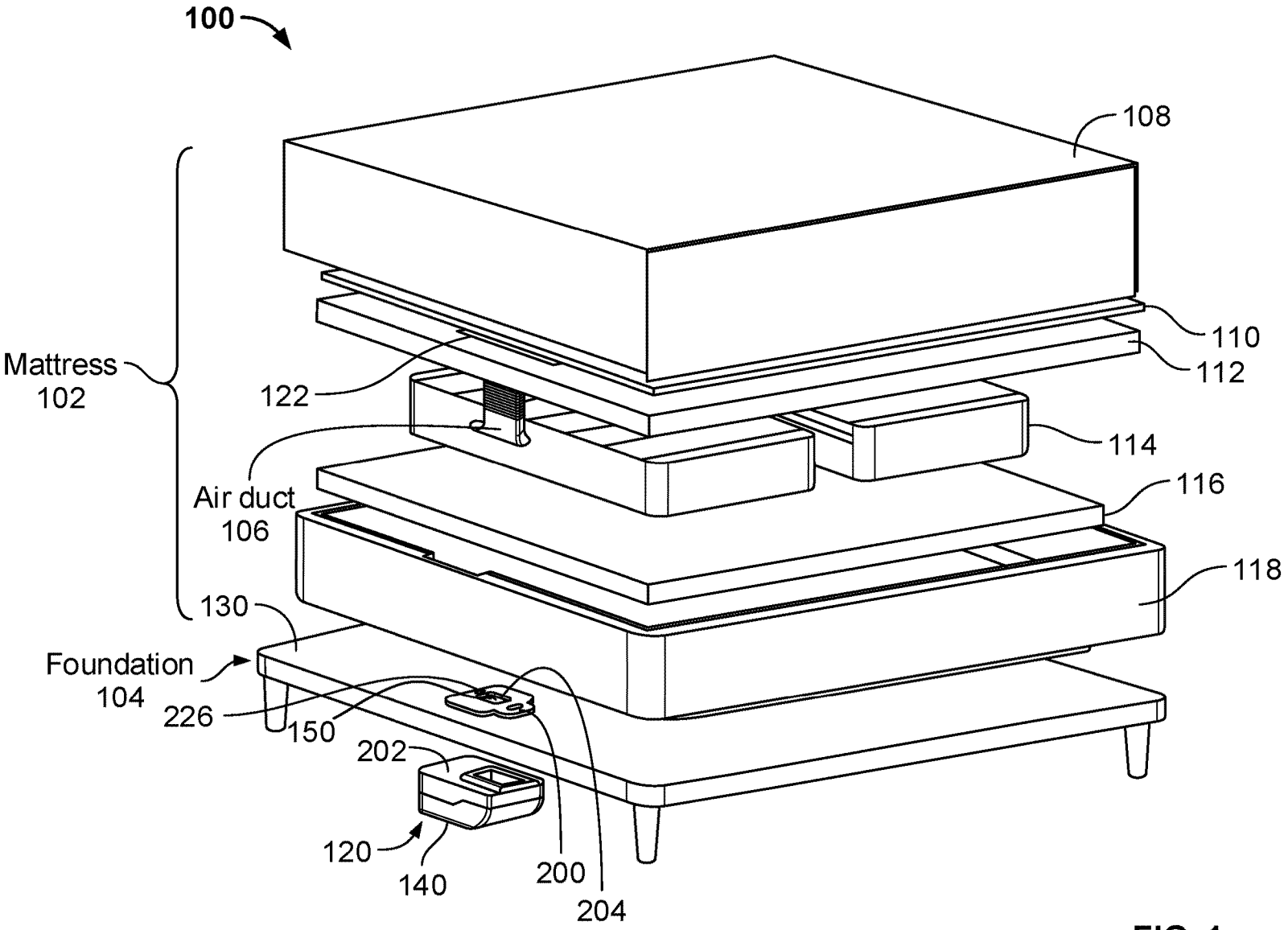
FIG. 1 is an example bed system having a modular air controller.

This document generally relates to modular air controllers (e.g., thermal engines) that can be easily and quickly installed at bed systems without tools. In some implementations, the modular air controllers can be easily and quickly removed from bed systems with simple, household tools, such as butter knife, flathead screwdriver, or the like.

For example, some embodiments described herein can a retainer configured to mount a modular air controller. In some implementations, the retainer can be fixed to a top side or surface of a foundation that supports a mattress thereon. The retainer can provide a toolless connection interface configured to mount the air controller at a bottom side or surface of the foundation. For example, at least part of the toolless connection interface can extend at the bottom side or surface of the foundation and couple corresponding connection features of the air controller at the bottom side or surface of the foundation. Alternatively, the retainer can be fixed to the bottom side or surface of the foundation and configured to mount the air controller at the bottom side or surface of the foundation. The retainer can couple the air controller to the foundation such that an outlet or air vent of the air controller can align with a foundation aperture. Air can then flow out of the air controller through the outlet or air vent to one or more layers of a mattress that are positioned on top of the foundation. Air can also flow from the mattress, through the air controller, and then be exhausted through the outlet or air vent into an ambient environment in order to force cooler ambient air into a microclimate of the mattress system. The foundation aperture can also extend between first and second sides of the foundation, such as a top surface of the foundation and the bottom surface that is opposite the top surface. The retainer can be fixed to the foundation proximate to the foundation aperture. In some implementations, the foundation aperture can be a full aperture (e.g., having four sides). In some implementations, the foundation aperture can be a partial aperture (e.g., having three sides, two sides, one side).

In some implementations, the toolless connection interface can be positioned at least partially at the top surface of the foundation and can detachably couple with the air controller at the bottom surface of the foundation. When the air controller is coupled to the retainer, the outlet or air vent of the air controller can be aligned with the foundation aperture to direct air from the air controller through the foundation aperture. Moreover, in some implementations, an air duct hose of the mattress can couple to the air controller through the retainer. For example, the retainer provides a hose connection interface that can couple the air duct hose extending from the mattress. Alternatively, the air duct hose can be connected directly to the air controller without attachment to the retainer. In some implementations, the components described herein can be coupled or otherwise connected using one or more other techniques, including but not limited to twisting one component onto another, sliding one component onto another, and/or screwing one component onto another.

Referring to the figures, FIG. 1 is an example bed system 100 having an air controller 120. An example of the air controller 120 includes a modular thermal engine. In this example, the bed system 100 includes a mattress 102 and a foundation 104, which can be configured to be identical or similar to the mattresses and the foundations described herein. The foundation 104 can be a box type foundation with or without a hollow interior. Alternatively, the foundation 104 can also be of a plate type and can provide a solid plate that supports the mattress thereon. Other configurations of the foundation are also possible. The foundation 104 can provide a first foundation surface 130 and a second foundation surface 140 that is opposite to the first foundation surface 130. The first foundation surface 130 can be a top surface of the foundation 104 on which the mattress 102 is supported. The second foundation surface 140 can be a bottom surface of the foundation 104 that is reachable from under the foundation 104. As described herein, the air controller 120 can be attached to the second foundation surface 140 (e.g., the bottom surface of the foundation 104) so that the air controller 120 is placed and secured under the foundation 104.

In general, the mattress 102 can be configured as a climate-controlled mattress, and include a mattress core, an air distribution layer, an air hose, an air controller, and a mattress cover. Referring to FIG. 1, the mattress core can include an air chamber assembly 114. The air distribution layer can include an air distribution layer 122 (e.g., airflow inserts). The air hose can include an air duct hose 106. The mattress cover can include a mattress cover 108. The mattress core is configured to support a user resting on the mattress. The air distribution layer is configured to facilitate air flow for climate control of a top surface of the mattress. The air hose is configured to route ambient or conditioned air into and from the air distribution layer. The air controller is fluidly connected to the air distribution layer via the air hose, and operates to cause ambient or conditioned air to flow into or from the air distribution layer. The mattress cover is used to enclose the mattress core, the air distribution layer, and at least part of the air hose.

Still referring to FIG. 1, the mattress 102 can include a top layer 110, an intermediate layer 112, an air distribution layer 122 (e.g., airflow inserts, airflow insert pads), a rail structure 118, a bottom layer 116, and an air chamber assembly 114. Any one or more of the layers 110, 112, 114, 116, and/or 118 can be made of foam, fabric, or another compressible material. Further, the mattress 102 can include a mattress cover 108 having a top surface, a bottom surface, and side surfaces, which are configured to at least partially cover the top layer 110, the intermediate layer 112, the rail structure 118, the bottom layer 116, and the air chamber assembly 114.

The air distribution layer 122 can be included in the mattress 102 and configured to circulate ambient or conditioned air through the mattress 102 under the user at rest. The airflow distribution layer 122 can be positioned under the top layer 110. In some implementations, the intermediate layer 112 defines a cutout section or recess to receive the airflow distribution layer 122 therein. As illustrated, the mattress 102 includes the air duct hose 106 that can fluidly connect to the airflow distribution layer 122. Conditioned air can then flow from the air controller 120, through the air duct hose 106, and into the airflow distribution layer 122 such that the conditioned air can be circulated around layers of the mattress 102. The air controller 120 can also be configured to draw air from the airflow distribution layer 122 into the air controller 120.

The airflow distribution layer 122 can include a material having a higher air permeability than the top layer 110, the intermediate layer 112 and/or other adjacent layers, thereby promoting airflow through the airflow distribution layer 122 as opposed to its adjacent layer(s) such as the top layer 110 and the intermediate layer 112. A single airflow distribution layer 122, two, or more than two airflow distribution layers 122 can be included in implementations of the mattress 102. The airflow distribution layer 122 can be arranged at various locations in the mattress 102. For example, the airflow distribution layer 122 can be disposed between the head and foot of the mattress 102 (e.g., in the middle of the mattress). The layer 122 can also be disposed closer to the head of the mattress 102 or the foot of the mattress 102 to optimize positioning without needing to rely on a foundation hole pass-through. In some implementations, the layer 122 can be laminated in place using adhesive. The layer 122 can also be held in place using one or more other attaching means, such as hook and loop fasteners and/or zippers.

As shown in FIG. 1, the modular thermal engine 120 can be inserted along the foundation 104 in a position in which the thermal engine 120 can receive the air duct hose 106. The thermal engine 120 can include a case 202 (e.g., housing). The case 202 can form a cavity for housing components of a fan assembly or other thermal module. The case 202 can be made of a plastic material. In some implementations, the foundation 104 can include two thermal modules 120 for the left and right sides of the bed system 100, respectively. Each thermal module can be used to selectively modify and control microclimates of the thermal module's respective side of the bed system 100. This can be beneficial when the bed system 100 is utilized by two sleepers. In some implementations, the foundation 104 can include one thermal module 120. The one thermal module can be used to modify and control microclimates of both sides of the bed system 100. In other implementations, more than two thermal modules can be used for control microclimates of multiple portions of the bed system 100 independently.

The bed system 100 can include a coupling structure for attaching the modular thermal engine 120 to the foundation 104. As described herein, the coupling structure can provide a toolless connection interface configured to couple the thermal engine 120 to the foundation 104 without requiring a tool. In some implementations, the coupling structure includes an attachment plate 200, which can also be referred to herein as an adapter or retainer. The attachment plate 200 can be made of a plastic material. The attachment plate 200 can have a retainer body 201. The attachment plate 200 can be mounted to the first foundation surface 130 (e.g., the top surface of the foundation 104). The attachment plate 200 includes an opening 204 that is aligned with a foundation aperture 150 of the foundation 104 when the attachment plate 200 is fixed to the first foundation surface 130 of the foundation 104. For example, the retainer body 201 can be fixed at a first foundation side (e.g., the first foundation surface 130) of the foundation 104 and defining the opening 204 that is aligned with the foundation aperture 150 being defined at the foundation 104. As described herein, the opening 204 of the attachment plate 200 is also aligned with an air vent 226 of the thermal engine 120. Further, the opening 204 of the attachment plate 200 can be sized to receive the air duct hose 106 extending from the distribution layer 122, such that the air duct hose 106 extending from the distribution layer 122 can be in fluid communication with the thermal engine 120 through the opening 204 of the attachment plate 200, the foundation aperture 150 of the foundation 104, and the air vent 226 of the thermal engine 120.

As described herein, the modular thermal engine 120 can be removably attached to the foundation 104 such that the engine 120 can be easily interchangeable and/or replaced. The attachment plate 200 can remain fixed to the foundation 104 while the thermal engine 120 is coupled to, or decoupled from, the attachment plate 200. A user can use a household tool or item, such as a butter knife or flathead screwdriver, to separate or detach the attachment plate 200 from the case 202, thereby removing the thermal engine 120 from the foundation 104. A user can, for example, remove the modular thermal engine 120 to put a different thermal engine, such as a thermal engine of the same or different model. Such a different thermal engine can be attached to the foundation 104 in the same manner described herein, for example by snapping the case 202 of the different thermal engine to the attachment plate 200. The case 202 can also be attached to the attachment plate 200 using other latching mechanisms, including but not limited to sliding, rotating, and/or threading the case 202 onto the attachment plate 200. Moreover, since the case 200 can be easily detached from the attachment plate 200, the thermal engine 120 can be attached to different types of foundations and different versions of foundations having the foundation aperture 150 and/or air duct hose 106 as described throughout this disclosure.

Figure 6:
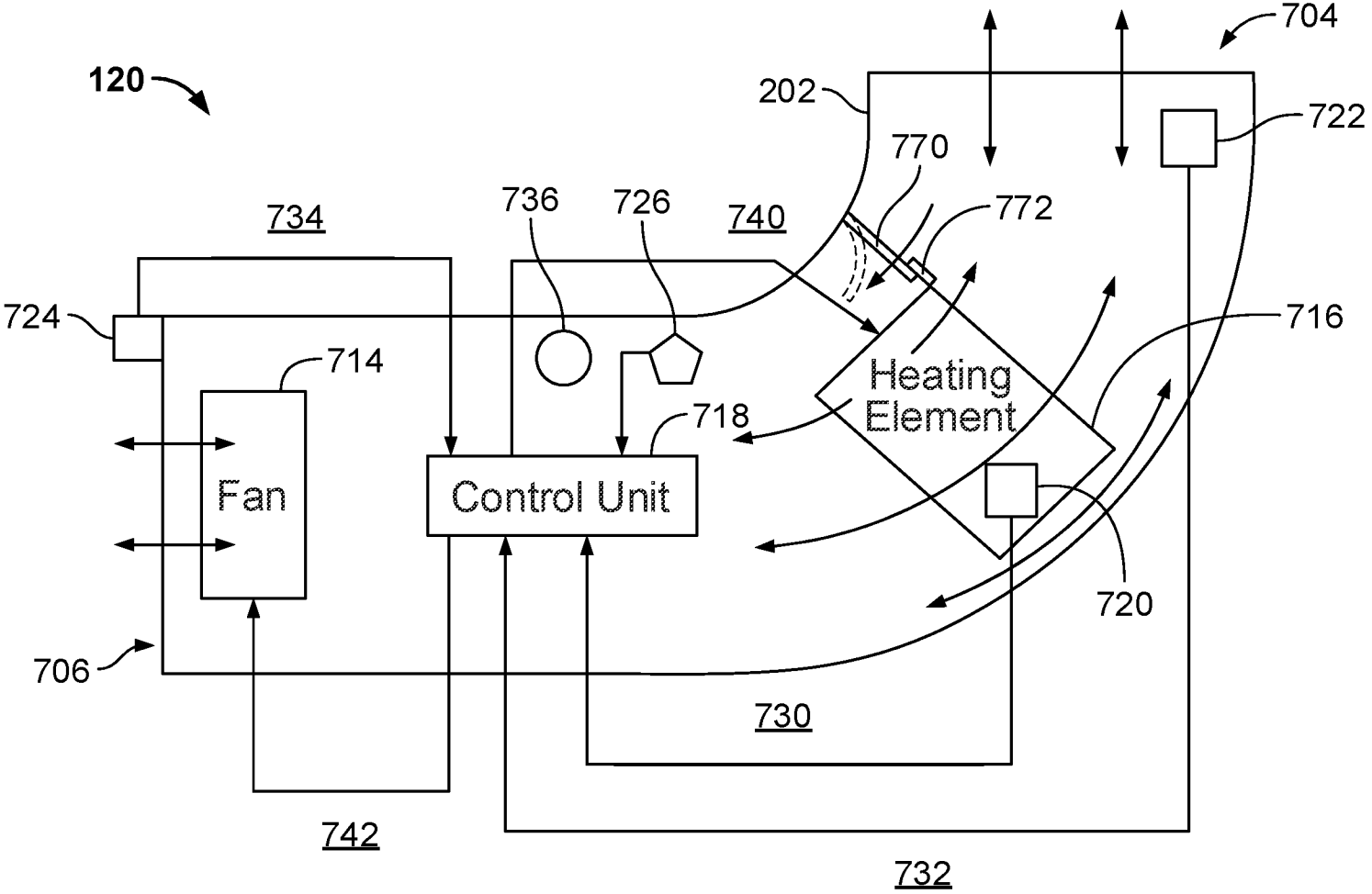
FIG. 6 is a diagram of an example control of the modular air controller.
Figure 7A:
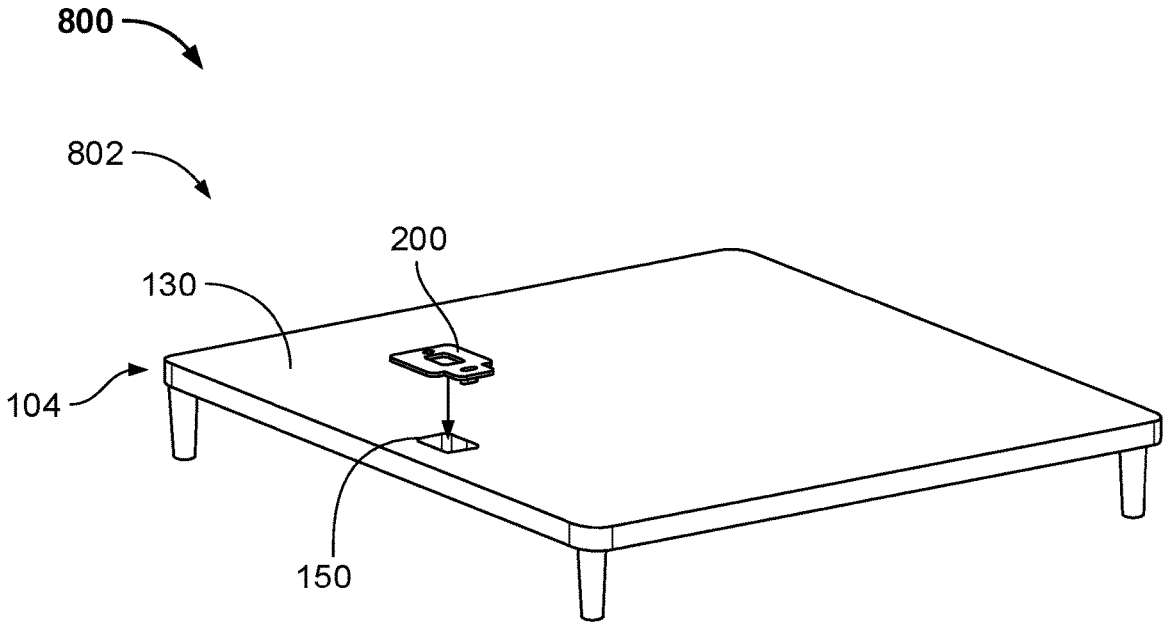
FIG. 7A-D depicts a process for installing the modular air controller on the foundation of the example bed system.
Figure 7B:
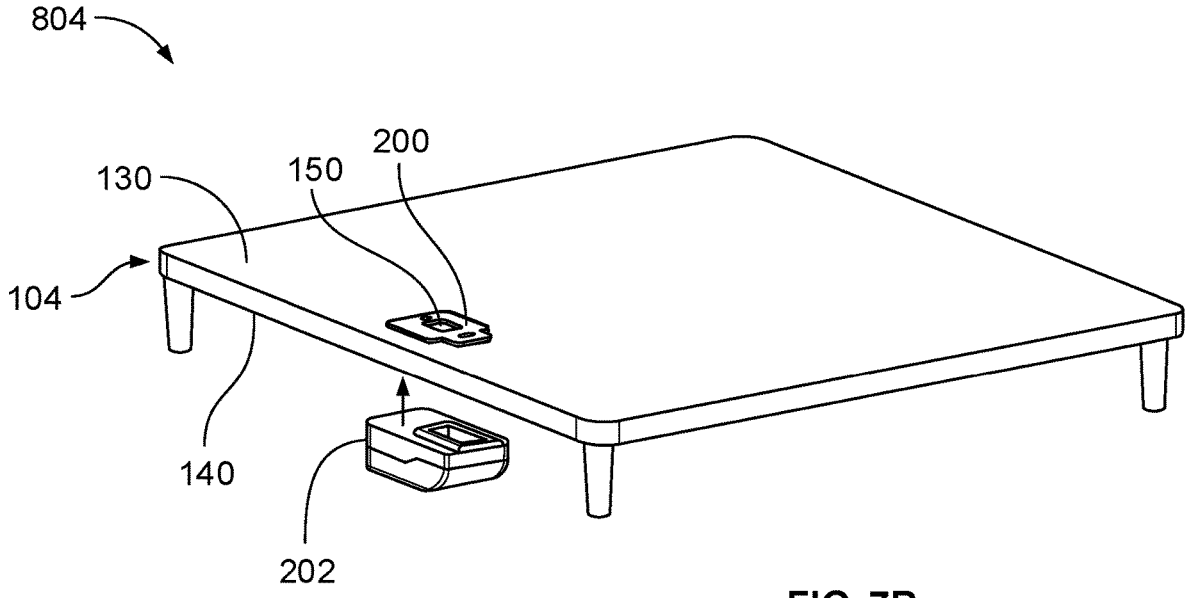
Figure 7C:
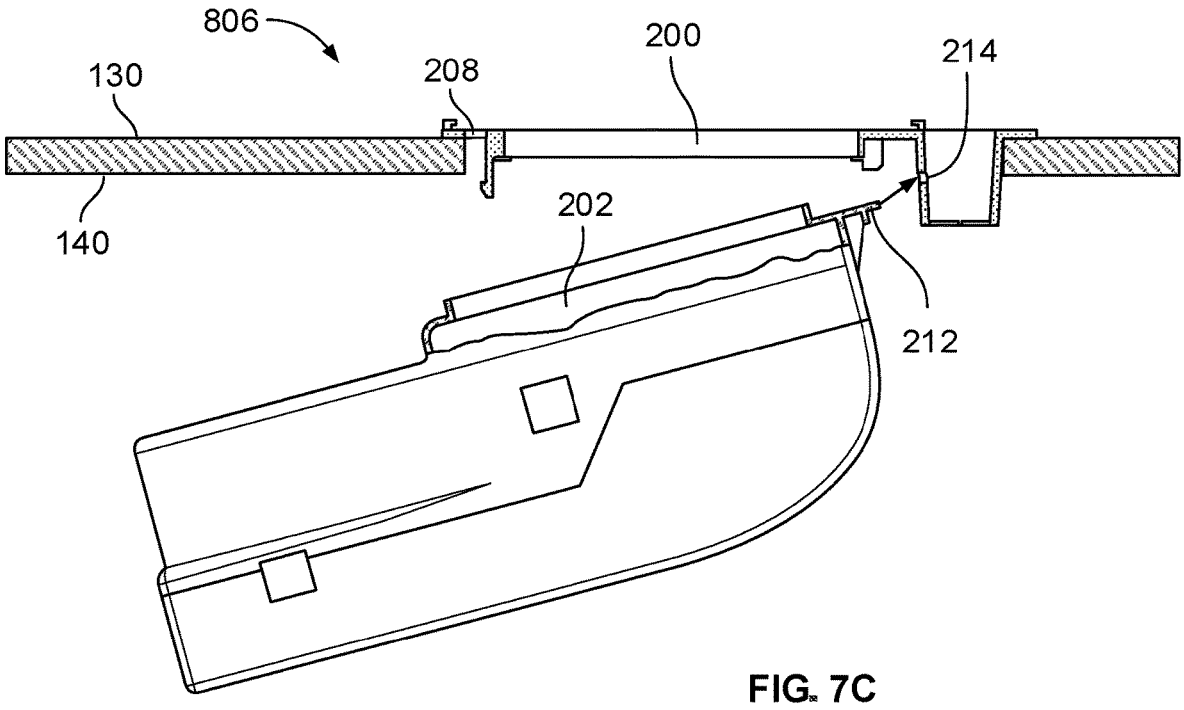
Figure 7D:
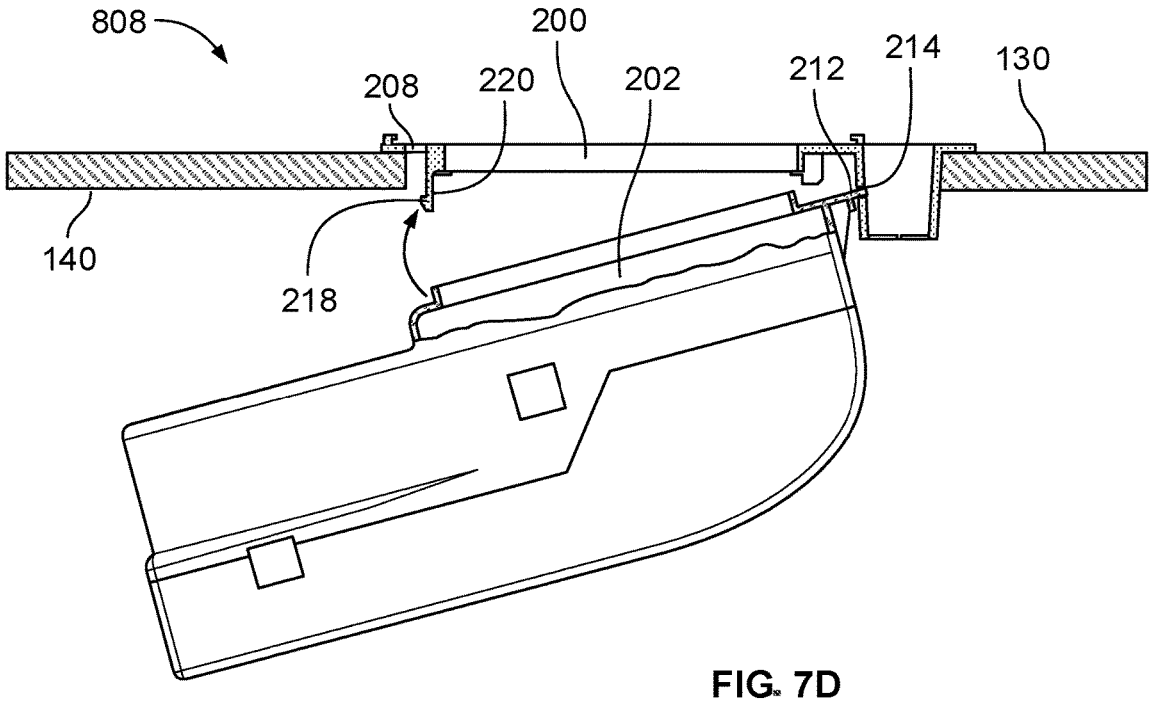
Figure 8A:
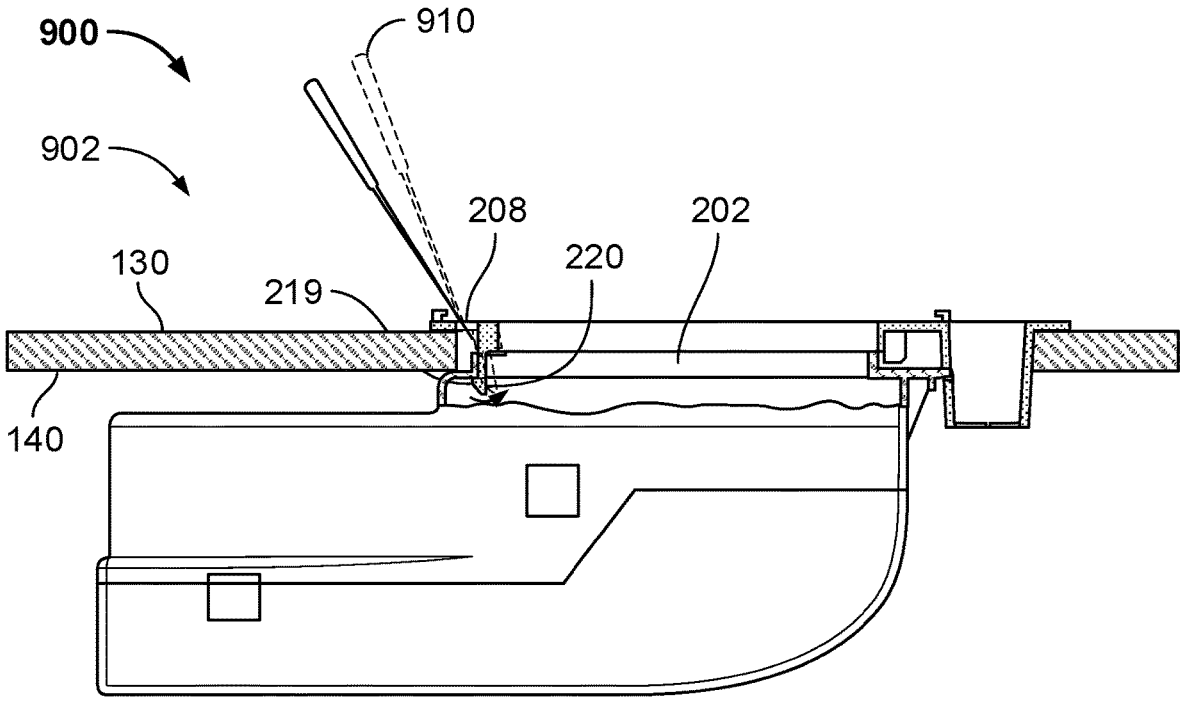
FIG. 8A-D depicts a process for removing the modular air controller from the foundation of the example bed system.
Figure 8B:
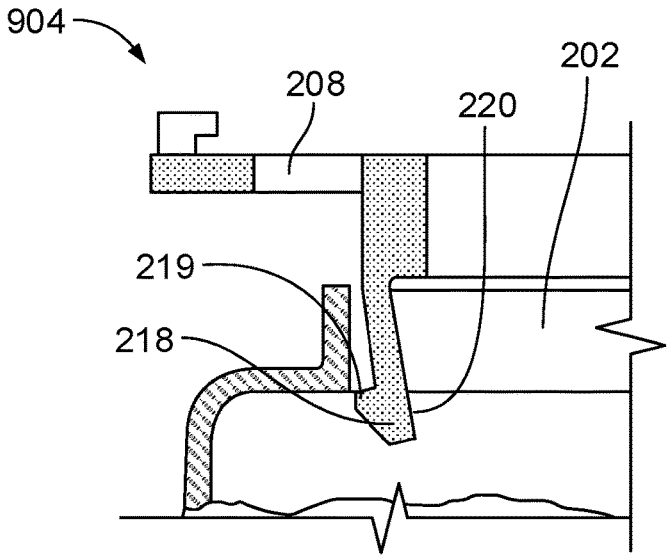
Figure 8C:
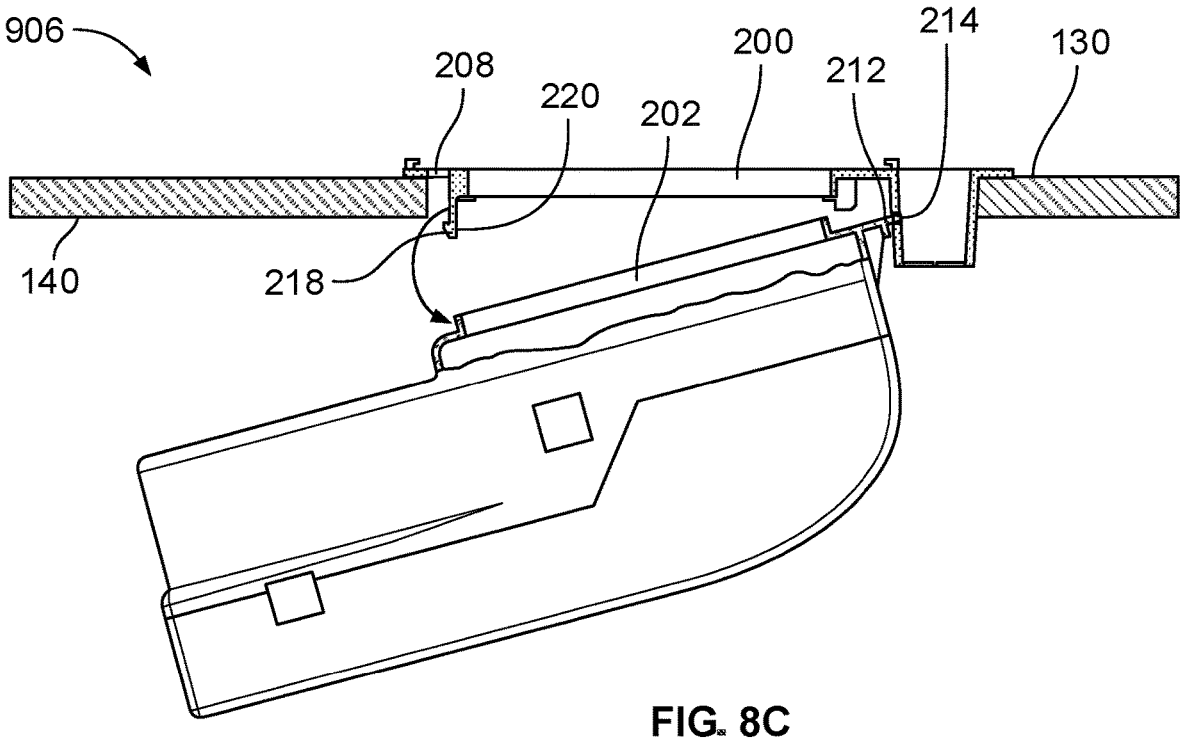
Figure 8D:
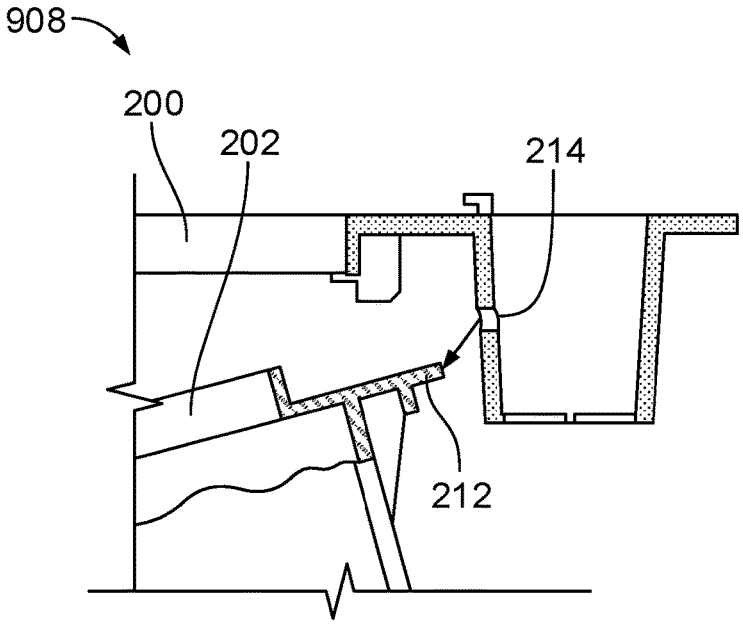

In some implementations, as described in reference to FIG. 6, the thermal engine 120 can include fan assembly components, which can be configured to move air into or from an airflow layer or other layers in the bed system 100. For example, the thermal engine 120 can include a fan assembly configured to draw air from the airflow layer of the mattress, and/or supply ambient or conditioned air to the airflow layer. In addition, one or more components in the thermal engine 120 can be configured to condition air before supplying it to the airflow layer or other layers in the mattress. For example, components in the thermal engine 120 can operate to heat or cool air and cause the heated or cooled air to flow into the airflow layer.

Figure 2:
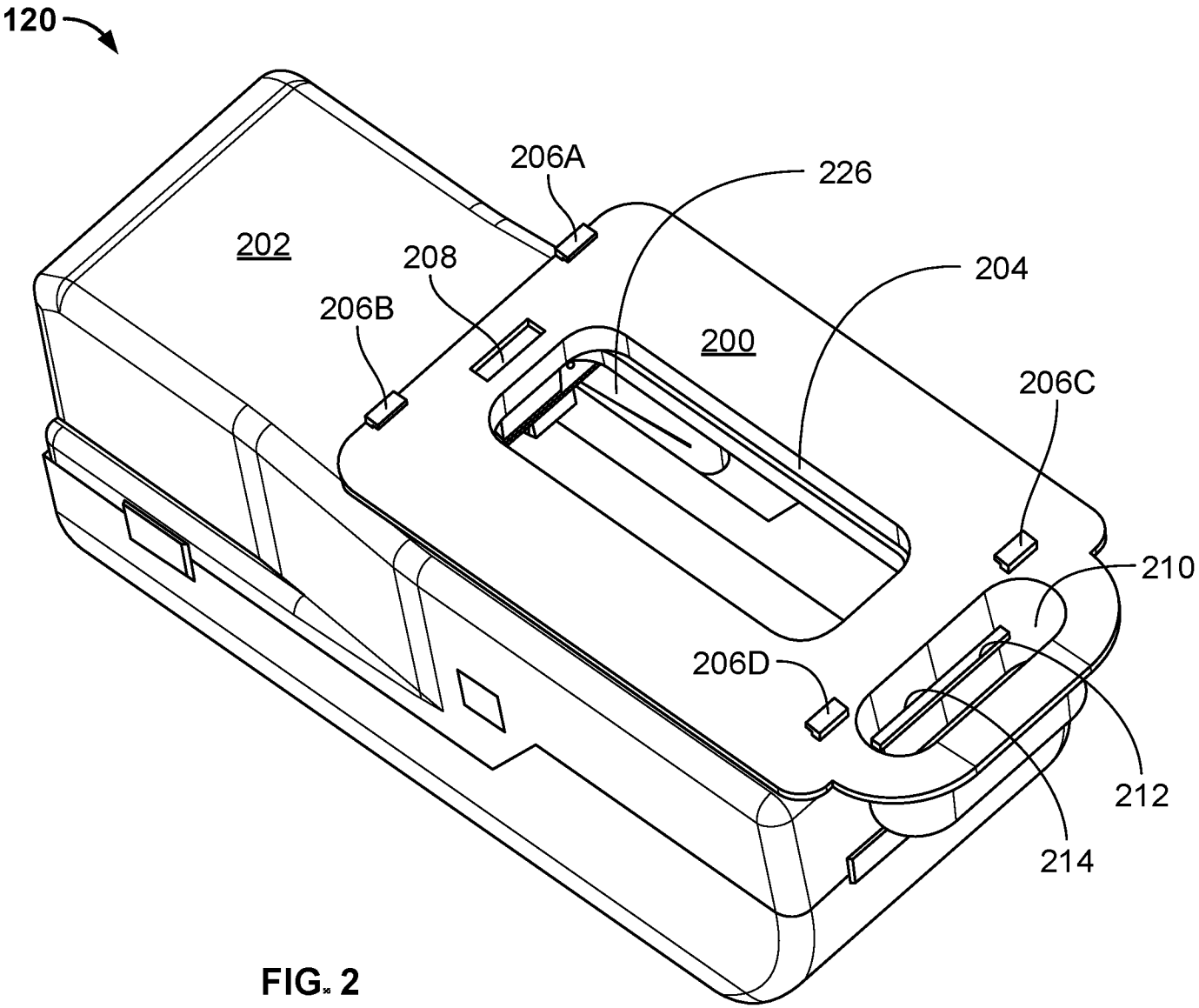
FIG. 2 is a perspective view of the modular air controller described herein.

FIG. 2 is a perspective view of the modular thermal engine 120 described herein. The engine 120 includes the attachment plate 200 and the case 202. For brevity purposes, FIG. 2 illustrates that the case 202 is attached (e.g., snapped, hooked, etc.) to the attachment plate 200 without a foundation or other a bed structure that mounts the case 202. However, as described throughout this disclosure, the case 202 is configured to be placed at a bottom surface of the foundation and coupled (e.g., snap-fitted, etc.) to the attachment plate 200 which is placed at a top surface of the foundation.

The case 202 can house components of a fan assembly and/or other thermal module as described herein (e.g., refer to FIG. 6). When the attachment plate 200 is fitted to the case 202 (e.g., snap-fit), an opening 204 of the attachment plate 200 is aligned with an air vent 226 of the case 202 so that air can flow through the opening 204 and the air vent 226. The opening 204 of the attachment plate 200 can also be sized to receive and retain an air duct hose that extends from the mattress (e.g., the air duct 106 extending from the distribution layer 122), as described above. The air duct hose (e.g., the air duct 106) can be configured to direct airflow generated from the components inside the case 202 to one or more layers of a bed system, such as an airflow distribution layer (e.g., the distribution layer 122). In some implementations, the opening 204 in the attachment plate 200 can be sized to accommodate a size of the air duct hose.

The attachment plate 200 can include snaps 206A-D, an opening 208, a wire retaining cup 210, and a slit 214. In some implementations, the slit 214 can be defined at a portion (e.g., a wall) of the attachment plate 200 that is adjacent to, defines, or surrounds, the wire retaining cup 210. The snaps 206A-D can be configured to couple an air duct hose (e.g., the air duct 106). In some implementations, the snaps 206A-D are configured to fit or lock into corresponding features (e.g., openings) in an air duct hose adapter fitted to an end of the air duct hose, so that the air duct hose can be retained in place to the attachment plate 200. Refer to FIG. 9B for additional discussion about alternative means for coupling the air duct hose to the attachment plate 200 (e.g., the engagement tabs 1022A and 1022B).

The opening 208 of the attachment plate 200 can be used to facilitate removal or detachment of the case 202 from the attachment plate 200, as described further herein. The wire retaining cup 210 can be configured to receive wiring, conduits, or other electrical, hydraulic, or pneumatic connection elements from components of the bed system. For example, the wire retaining cup 210 can be used to route hydraulic or pneumatic conduits and/or electrical wires from the air chamber assembly 114, so that the conduits and/or wires can be coupled to a system (e.g., a pump system) configured to inflate the air chamber assembly 114. Alternatively or in addition, the wire retaining cup 210 can be used to route wires and/or conduits for components of the fan assembly or other thermal module that are housed inside the case 202 or outside the case 202. The wire retaining cup 210 can be advantageous to keep the wiring organized and to run the wires away from the bed system without compromising on an aesthetic appeal of the bed system.

In some implementations, the retaining cup 210 defines the slit 214. The case 202 can include an engagement flange 212 that corresponds to the slit 214. For example, the slit 214 is configured to receive the engagement flange 212 of the case 202. The flange 212 can slide or fit into the slit 214 to retain or secure the case 202 to the attachment plate 200. Fitting the flange 212 into the slit 214 may not require tools, skill, or expertise. A user can merely align the flange 212 with the slit 214, slide the flange 212 into the slit 214, and then push the case 202 up against the attachment plate 200 to lock the case 202 to the plate 200 (e.g., refer to FIG. 4). As described above, the case 202 defines an air vent 226 through which air can flow into and out of the case 202. In some implementations, the engagement flange 212 can extend away from the air vent 226.

To separate the case 202 from the attachment plate 200, the user can use any type of tool or household item (e.g., a butter knife, flathead screwdriver) to pry apart the case 202 and the plate 200. For example, a household item can be inserted into the opening 208. The user can move the household item within the opening 208, as described in more detail below, to easily and quickly separate or detach the case 202 from the attachment plate 200. Detaching the case 202 from the plate 200 may not require any tools, skill, or expertise specialized for the particular design of the plate 200 and/or the case 202. Instead, a user of any skill level can simply and intuitively pry apart the case 202 and the plate 200 to remove the thermal engine 120 from the foundation. The user can then perform maintenance on the thermal engine 120 or swap out or replace components that are housed in the case 202. Servicing the thermal engine 120 can be performed more immediately and at a home of the user without needing to call in skilled workers to assess a problem with the thermal engine 120 and fix it.

Figure 3:
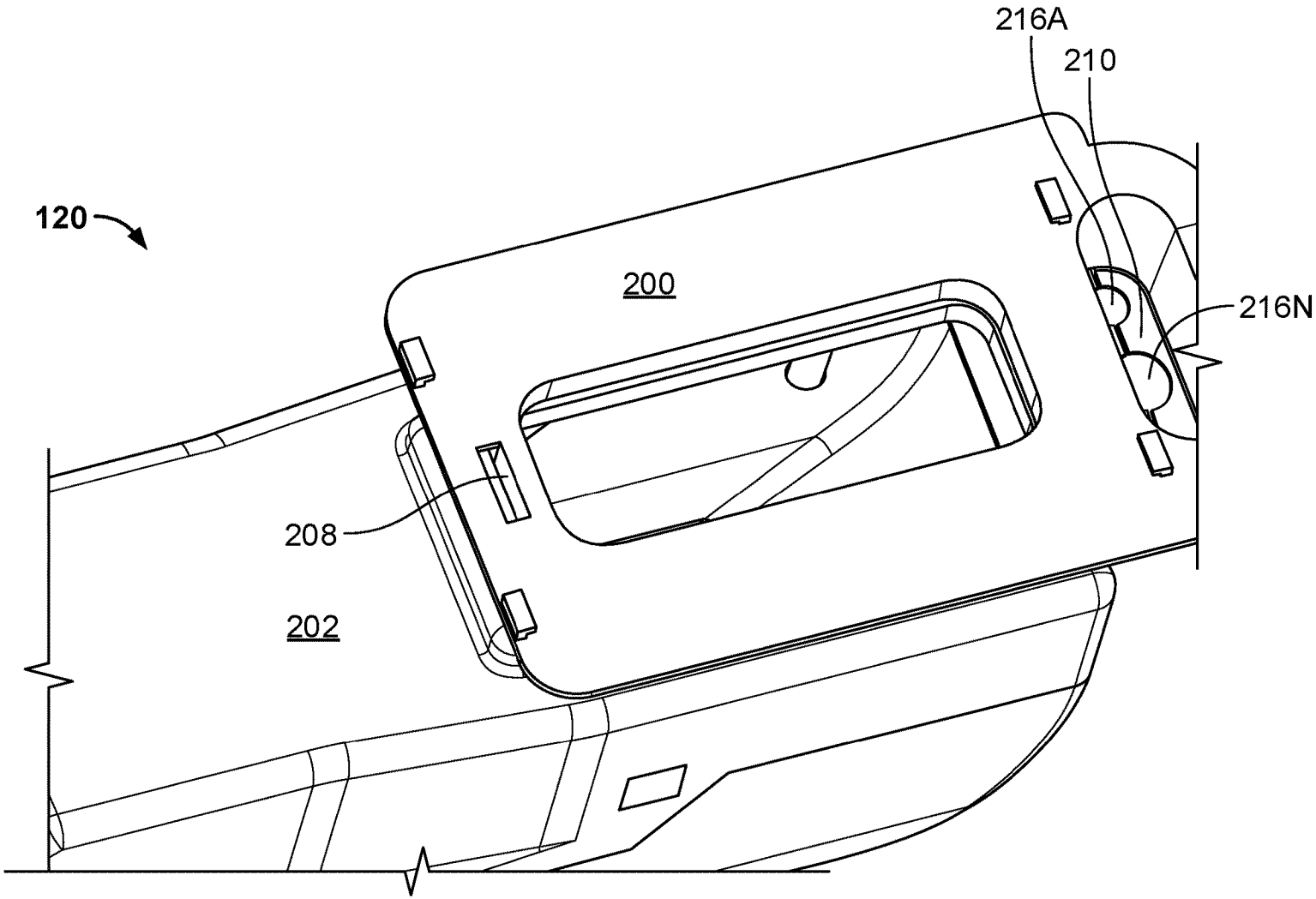
FIG. 3 is another perspective view of the modular air controller.

FIG. 3 is another perspective view of the modular thermal engine 120. The wire retaining cup 210 can include openings 216A-N for organizing, directing, and routing wires for one or more components of the bed system. As described herein, the wire retaining cup 210 can be used to route hydraulic or pneumatic conduits and/or electrical wires from the air chamber assembly to inflate the air chamber assembly. Alternatively or in addition, the wire retaining cup 210 can be used to route wires and/or conduits for components of the fan assembly or other thermal module that are housed inside the case 202 or outside the case 202.

As shown in FIG. 3, the opening 208 can be large or wide enough to receive a common household item, such as a flathead screwdriver or butter knife, to separate the attachment plate 200 and the case 202. The user may not need to use any special or specific tools to separate the plate 200 and the case 202.

Figure 4:
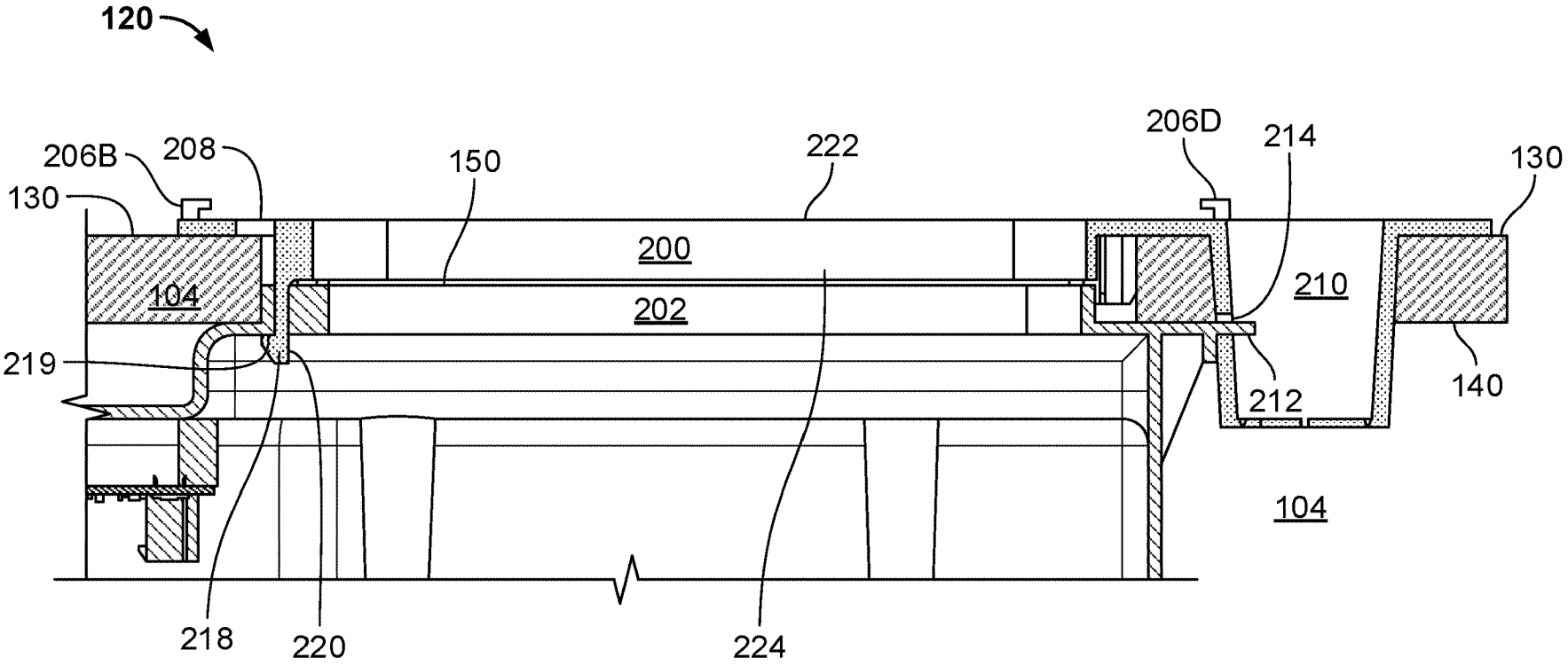
FIG. 4 is a cross-sectional side view of the modular air controller on the foundation of the example bed system.
Figure 5:
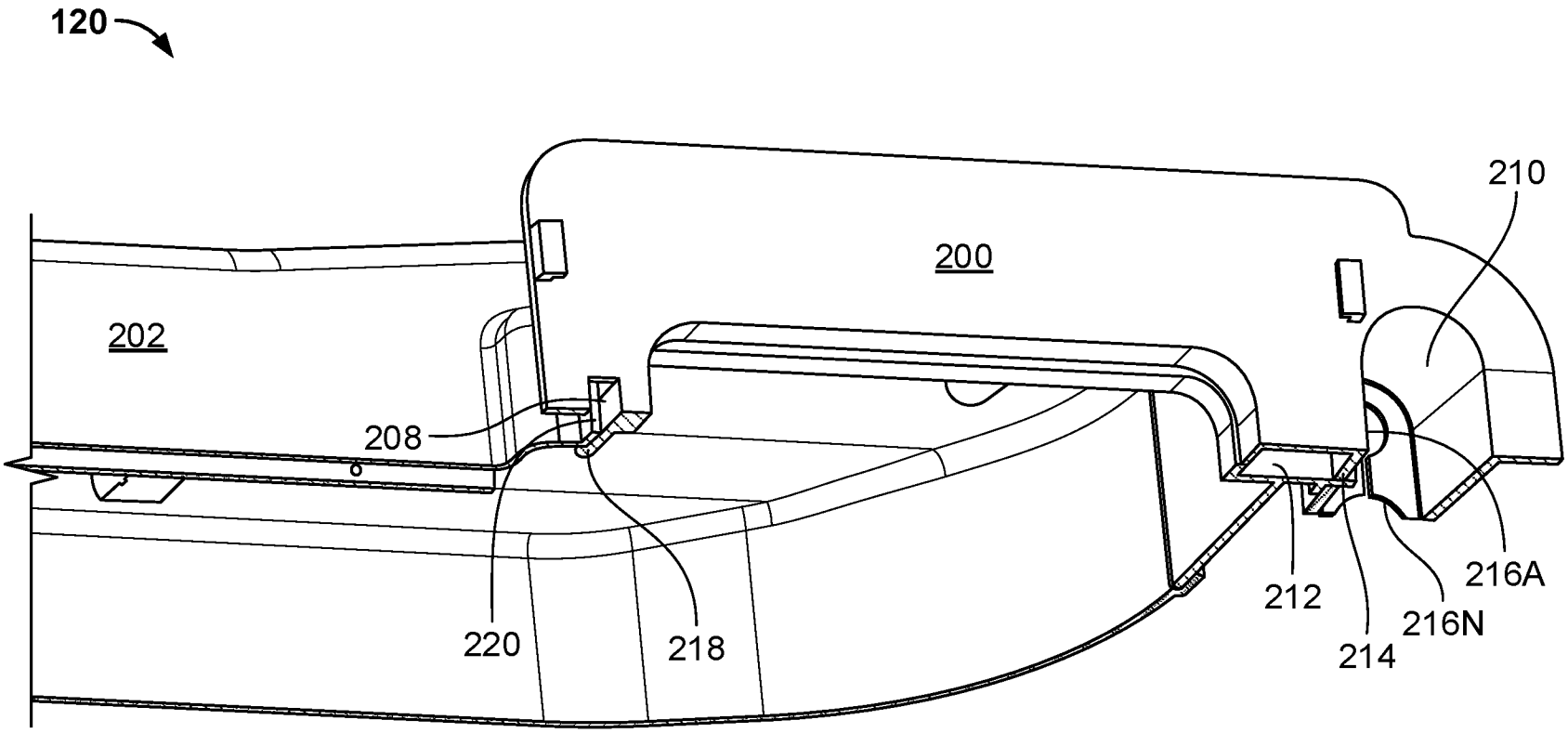
FIG. 5 is an exploded perspective view of the module air controller.

FIG. 4 is a cross-sectional side view of the modular thermal engine 120 when configured to the foundation 104 of the example bed system 100. FIG. 5 is an exploded perspective view of the modular thermal engine 120. The foundation 104 can be of various types, such as a box foundation or a plate. Referring to both FIG. 4 and FIG. 5, a portion of the foundation 104 is disposed between the case 202 and the attachment plate 200. As shown, the case 202 hooks (e.g., snaps) to the attachment plate 200 with the portion of the foundation 104 interposed therebetween. Where the foundation 104 is a box type having a hollow interior, the portion of the foundation 104 can be a top plate of the foundation. Where the foundation 104 is constructed as a plate, the portion of the foundation 104 can be the plate.

The foundation 104 has a first foundation side 130 and a second foundation side 140. The foundation 104 can support a mattress on the first foundation side 130. The first foundation side 130 can define the foundation aperture 150 extending between the first foundation side 130 and the second foundation side 140. The thermal engine 120 can include, or be configured as, an air controller configured to cause air to flow through an air duct, as described throughout this disclosure. As described herein, when mounted to the foundation 104, an air inlet/outlet (e.g., the air vent 226) of the thermal engine 120 is aligned with the foundation aperture 150 so that air that flows from or into the thermal engine 120 passes through the foundation aperture 150 of the foundation 104.

The attachment plate 200 (e.g., a controller retainer) can be fixed to the foundation 104 and can define an opening (e.g., the opening 204) that is aligned with the foundation aperture 150. The opening of the attachment plate 200 can also be aligned with the air inlet/outlet of the thermal engine 120 that is attached to the foundation 104 via the attachment plate 200. The attachment plate 200 can also include a toolless connection interface exposed at the second foundation side 140 and configured to detachably couple the thermal engine 120 at the second foundation side 140. Moreover, the opening of the attachment plate 200 can be in fluid communication with components housed within the case 202 of the thermal engine 120.

The attachment plate 200 has a top plate surface 222 and a bottom plate surface 224. When the attachment plate 200 is attached to the foundation 104, the bottom plate surface 224 can abut with the first foundation side 130 (e.g., the top surface of the foundation 104) while the top plate surface 222 is exposed so that an air duct hose can be coupled at the top plate surface 222. The attachment plate 200 can have a relatively small thickness (e.g., a distance between the top plate surface 222 and the bottom plate surface 224) so that the attachment plate 200 does not cause significant discomfort above the mattress 102 that is supported on the foundation 104. An example thickness of the attachment plate 200 can range between 0.05 and 0.375 inches. An example nominal thickness can be 0.125 inches. In some implementations, the foundation 104 can define a recess for receiving the attachment plate 200 such that the top plate surface 222 of the attachment plate 200 is generally flush with the first foundation side 130 of the foundation 104.

As described herein, the case 202 of the thermal engine 120 can be placed up against the second foundation side 140 (e.g., the bottom surface) of the foundation 104 and oriented to be coupled with the attachment plate 200 at the second foundation side 140. For example, the case 202 can be snapped to the attachment plate 200 at the second foundation side 140 such that the modular thermal engine 120 can be retained in place to the foundation 104.

The attachment plate 200 includes a locking tab 220 that extends through the foundation apertures 150 and exposed at the second foundation side 140. The locking tab 220 can include a snapping end 218 that is configured to engage with an engagement portion 219 of the case 202 to thereby couple the case 202 to the attachment plate 200.

The locking tab 220 having the snapping end 218 is configured to be disengaged from the engagement portion 219 of the case 202 with or without a special tool. In some implementations, as described in reference to FIGS. 1-2, the user can insert a common household tool or item into the opening 208 and use the tool to pry the snapping end 218 of the locking tab 220 out from the engagement portion 219 in the case 202. In other words, the locking tab 220 can be configured to engage with a tool that is inserted into the opening 208 of the plate 200. With the tool being engaged with the locking tab 220, the locking tab 220 is configured to flex away from the engagement portion 219 of the case 202 to thereby disengage the snapping end 218 of the locking tab 220 from the engagement portion 219 of the case 202. Then, the user can move the case 202 away from the attachment plate 200 and the foundation 104. In some implementations, the attachment plate 200 remains fixed to the foundation 104 while the thermal engine 120 is coupled to, or decoupled from, the attachment plate 200. In alternative implementations, the attachment plate 200 is removable from the foundation 104 so that the user can lift the attachment plate 200 from the foundation 104 while the case 202 is disengaged from the attachment plate 200. In so doing, the user can remove or detach the case 202 from the attachment plate 200.

As depicted, the engagement flange 212 of the case 202 can extend away from the case 202. The flange 212 can be sized to fit into the slit 214 of the wire retaining cup 210. The flange 212 of the case 202 can be configured to retain the case 202 to the attachment plate 200 and arrange the case 202 in proper place and orientation relative to the attachment plate 200 so that the case 202 can be moved toward the attachment plate 200 until the engagement portion 219 of the case 202 engages with the snapping end 218 of the locking tab 220 of the attachment plate 200.

For example, to attach the case 202 to the attachment plate 200, the flange 212 of the case 202 can be inserted or slid into the slit 214 defined at the wire retaining cup 210 of the attachment plate 200. While the flange 212 is inserted into the slit 214, the user can push the case 202 up towards the attachment plate 200 that is fixed to the foundation 104, such that the snapping end 218 can be received through the opening 208 of the case 202 and engaged with the engagement portion 219 of the case 202. In implementations where the attachment plate 200 is removable from the foundation 104, when the flange 212 is inserted into the slit 214, the user can push the attachment plate 200 down towards the case 202 such that the snapping end 218 can be received through the opening 208 of the case 202 and engaged with the engagement portion 219 of the case 202. As such, while the flange 212 is fitted through the slit 214, the snapping end 218 can find the opening 208 of the attachment plate 200 and be inserted through the opening 208 until being engaged with the engagement portion 219 of the case 202. This way, the case 202 can be easily snap-fitted to or otherwise attached to the attachment plate 200.

The case 202 can also be easily removed from the attachment plate 200. For example, the user can simply grab a household item having an extended tip and insert it into the opening 208 to flex the locking tab 220 until the snapping end 218 is disengaged from the engagement portion 219 of the case 202. While the snapping end 218 is disengaged by the household item, the user can pull the case 202 away from the attachment plate 200 (e.g., in a direction opposite the wire retaining cup 210) to remove the engagement flange 212 from the slit 214. As a result, the user can separate the case 202 from the attachment plate 200, thereby removing the modular thermal engine 120 from the foundation 104.

In some implementations, as shown, the attachment plate 200 includes the snaps 206A-D that protrude a certain distance/height above the attachment plate 200. An adapter of an air duct hose can then slide between the protruding edges of the snaps 206A-D and the attachment plate 200. The adapter of the air duct hose can be retained or secured in place via the snaps 206A-D.

FIG. 6 is a diagram of an example control of the modular thermal engine 120. The thermal engine 120 can include a fan assembly 714 mounted in the case 202 (e.g., housing) and configured to cause air to flow through the case 202. In some implementations, the fan assembly 714 is configured as a reversible fan assembly configured to cause air to flow in opposite directions. For example, the fan assembly 714 can be operated to rotate a fan in one direction to cause air to flow from an ambient side 706 to a connection side 704 (e.g., the air vent 226) of the case 202. Further, the fan assembly 714 can be operated to rotate the fan in the opposite direction to cause air to flow from the connection side 704 to the ambient side 706 of the case 202. In some implementations, the fan assembly 714 is positioned at the ambient side 706 of the case 202 as illustrated. Other locations of the fan assembly 714 are possible in other implementations. For example, the fan assembly 714 can be positioned adjacent a heating element 716, such as between the heating element 716 and a PCB board (e.g., a control unit 718).

The thermal engine 120 can include a heating element 716 mounted in the case 202 and configured to heat air that passes through the heating element 716. In some implementations, the heating element 716 includes a plurality of fins that allow air flow in between the fins to be heated by the heating element. As described herein, the heating element 716 can be mounted in the case 202 in a location that is at least partially spaced from an inner wall of the case 202 so as to define a bypass flow path that allows air to flow around the heating element 716 while air simultaneously flows through the heating element 716. Such a bypass flow path can allow effective air flow through the housing when air is drawn from the mattress and flows from the connection-side opening 708 to the ambient-side opening 710, or when air is supplied and flows from the ambient-side opening 710 toward the connection-side opening 708 with or without activating the heating element 716.

The thermal engine 120 can include a control unit 718 mounted in the case 202 and configured to control one or more components in the thermal engine 120 in one or more operational modes. For example, the control unit 718 can operate components in the thermal engine 120 in a first mode (e.g., ambient-air-drawing mode) in which the control unit 718 controls the fan assembly 714 to cause air to flow from the connection side 704 to the ambient side 706 so that air is drawn from the airflow layer of the mattress. Alternatively or in addition, the control unit 718 can operate components in the thermal engine 120 in a second mode (e.g., heating-air-supplying mode) in which the control unit 718 activates the heating element 716 and controls the fan assembly 714 to cause air to flow from the ambient side 706 to the connection side 704 so that the air passes through the heating element 716 and the heating air is supplied to the airflow layer of the mattress. Alternatively or in addition, the control unit 718 can operate components in the thermal engine 120 in a third mode (e.g., ambient-air-supplying mode) in which the control unit 718 controls the fan assembly 714 to cause air to flow from the ambient side 706 to the connection side 704 (without activating the heating element 716) so that ambient air is supplied to the airflow layer of the mattress.

In alternative embodiments, the thermal engine 120 can include a cooling unit with or without the heating element 716, so that the thermal engine 120 can be operated in additional operational modes. For example, the control unit 718 can operate components in the thermal engine 120 in a fourth mode (e.g., cooling-air-supplying mode) in which the control unit 718 activates the cooling element and controls the fan assembly 714 to cause air to flow from the ambient side 706 to the connection side 704 so that the air passes through the cooling element and the cooling air is supplied to the airflow layer of the mattress.

The thermal engine 120 can be configured with a printed circuit board. The printed circuit board can be positioned in the case 202 between the ambient-side opening 710 and the heating element 716. The fan assembly 714 can be positioned in the case 202 between the ambient-side opening 710 and the heating element 716. The thermal engine 120 can be electrically connected to the fan assembly 714 and the heating element 716 to control operation of the fan assembly 714 and the heating element 716.

The thermal engine 120 can include one or more temperature sensors configured to detect temperatures at different locations. For example, the thermal engine 120 can include a first temperature sensor 720 configured to detect a temperature of the heating element 716 and generate a sensor signal 730 representative of the heating element temperature. The air controller 700 can include a second temperature sensor 722 configured to detect an outlet temperature of air existing the case 202, such as a temperature of air existing at the connection side 704, and generate a sensor signal 732 representative of the outlet air temperature. The control unit 718 can receive the sensor signals 730 and 732 from the first and second temperature sensors 720 and 722, and control the heating element 716 based at least in part on the sensors signals 730 and 732 to achieve a predetermined outlet air temperature. For example, the control unit 718 can determine an offset value of the detected outlet air temperature from the predetermined outlet air temperature, and controls the heating element 716 to compensate the offset value so that the outlet air temperature reaches the predetermined outlet air temperature.

The second temperature sensor 722 can be used to detect a temperature of air drawn into the case 202 from, for example, the airflow layer of the mattress, and generate a sensor signal 732 representative of the drawn air temperature. Alternatively, the thermal engine 120 can include a separate temperature sensor (e.g., a third temperature sensor) for detecting the drawn air temperature. The thermal engine 120 can further include a fourth temperature sensor 724 configured to detect an ambient temperature and generate a sensor signal 734 representative of the ambient temperature. The control unit 718 can receive the sensor signals 732 and 734 from the second (or third) and fourth temperature sensors 722 and 724, and control the fan assembly 714 based at least in part on the sensors signals 732 and 734 to achieve a predetermined drawn air temperature. For example, the control unit 718 can determine an offset value of the detected drawn air temperature from the predetermined drawn air temperature, and controls the fan assembly 714 to compensate the offset value so that the drawn air temperature reaches the predetermined drawn air temperature. In addition, the control unit 718 can calculate an amount of heat extracted from the airflow layer of the mattress based on the sensor signals 732 and 734.

In addition, the thermal engine 120 can include one or more humidity sensors 726 configured to detect a humidity value and generate a sensor signal 736 representative of the humidity value. The control unit 718 can receive the sensor signal 736 and control the fan assembly 714 and/or the heating element 716 based in part on the sensor signal 736 to achieve a predetermined humidity value. For example, the control unit 718 can determine an offset value of the detected humidity value from the predetermined humidity value, and controls the fan assembly 714 and/or the heating element 716 to compensate the offset value so that the humidity reaches the predetermined humidity value.

FIG. 7A-D depicts a process 800 for installing the modular air controller 120 on the foundation 104 of the example bed system. The attachment plate 200 can be fixed to the foundation 104 (802). The case 202 can be coupled to the attachment plate 200 at the bottom surface 140 of the foundation 104 (e.g., a lower side of the foundation) (804). To do so, the engagement flange 212 of the case 202 can be inserted into the slit 214 of the attachment plate 200 in a first direction (806). While the engagement flange 212 of the case 202 is being inserted into the slit 214 of the attachment plate 200, the case 202 can be moved upwards against the bottom surface 140 of the foundation 104 while the attachment plate 200 is mounted in place to the top surface 130 of the foundation 104. The case 202 can move upwards against the bottom surface 140 until the snapping end 218 of the locking tab 220 engages with engagement portion 219 of the case 202 (808).

Although not depicted in FIG. 7, the mattress 102 can also be positioned at the top surface 130 of the foundation 104 (e.g., an upper side of the foundation). The air duct hose 106, which extends from an air distribution layer (e.g., the airflow insert layer 122) of the mattress 102, can be coupled to the attachment plate 200 at the top surface 130 of the foundation 104, so that the air distribution layer is in fluid communication with the case 202 of the thermal module through the air duct hose 106.

The first direction can be perpendicular to the second direction. Moreover, the first direction can be parallel with the bottom surface 140 of the foundation 104. The second direction can be perpendicular to the bottom surface 140 of the foundation 104.

FIG. 8A-D depicts a process 900 for removing the modular air controller 120 from the foundation 104 of the example bed system. The locking tab 220 of the attachment plate 200 can be flexed by engaging a tool 910 through the opening 208 and between the locking tab 220 and the engagement portion 219 of the case 202 (902). As described herein, the tool 910 can be a household item, such as a butter knife, a flathead screw driver, or any suitable tool or item having an extended tip. While the flange 212 is still inserted in the slit 214, the case 202 can be moved downwards from the bottom surface 140 of the foundation 104 in a third direction. The attachment plate 200 can remain mounted in place to the top surface 130 of the foundation 104. The case 202 can be moved downwards in the third direction until the snapping end 218 of the locking tab 220 is lifted up through the opening 208 (904-906). The third direction can be opposite to the second direction described in reference to FIG. 7, where the second direction can be perpendicular to the bottom surface 140 of the foundation 104. The engagement flange 212 of the case 202 can then be removed from the slit 214 of the attachment plate 200 in a fourth direction (908). The fourth direction can be opposite from the first direction described in reference to FIG. 7, where the first direction can be parallel with the bottom surface 140 of the foundation 104.

Figure 9A:
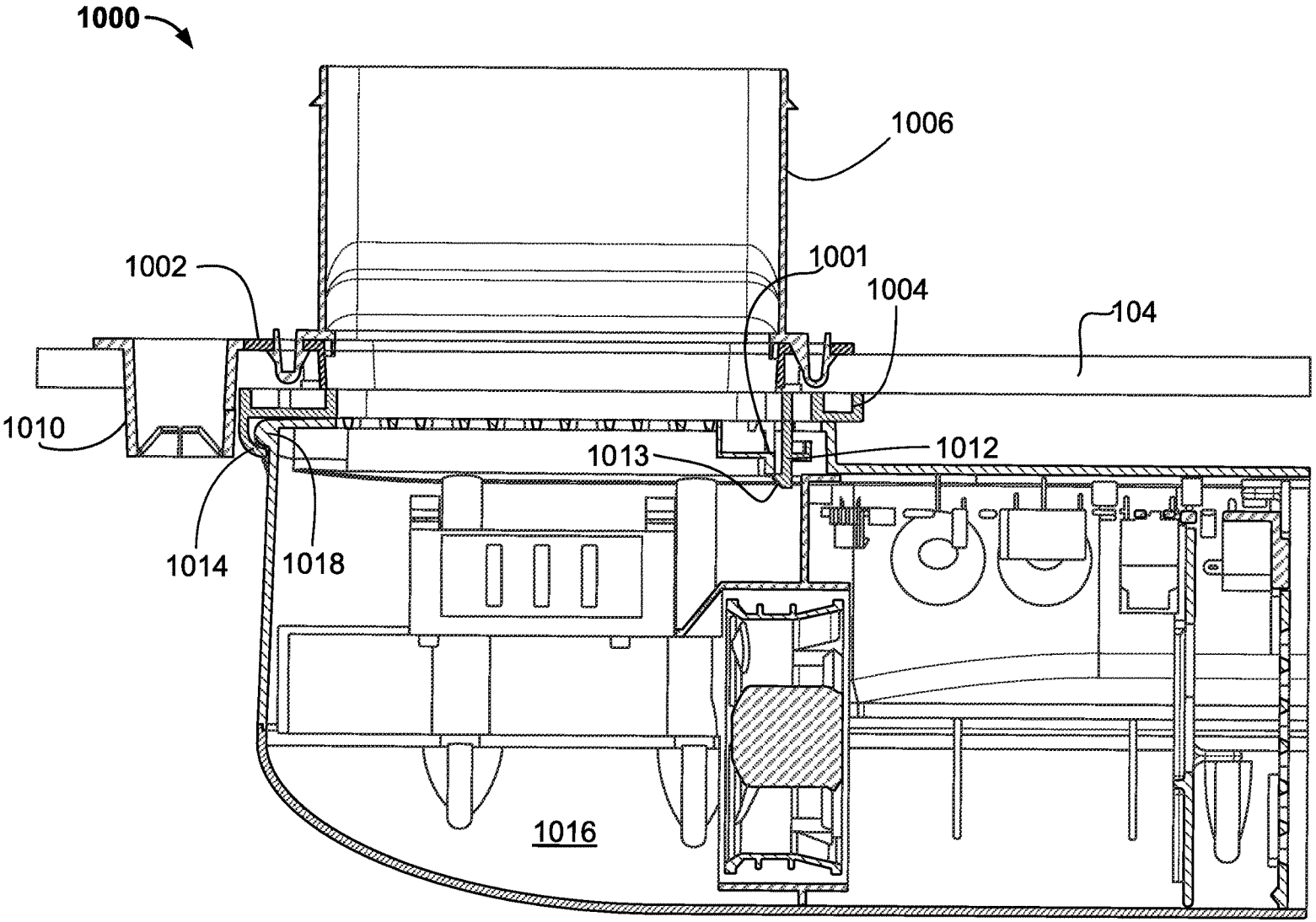
FIGS. 9A-B are cross-sectional side views of another example modular air controller.
Figure 9B:
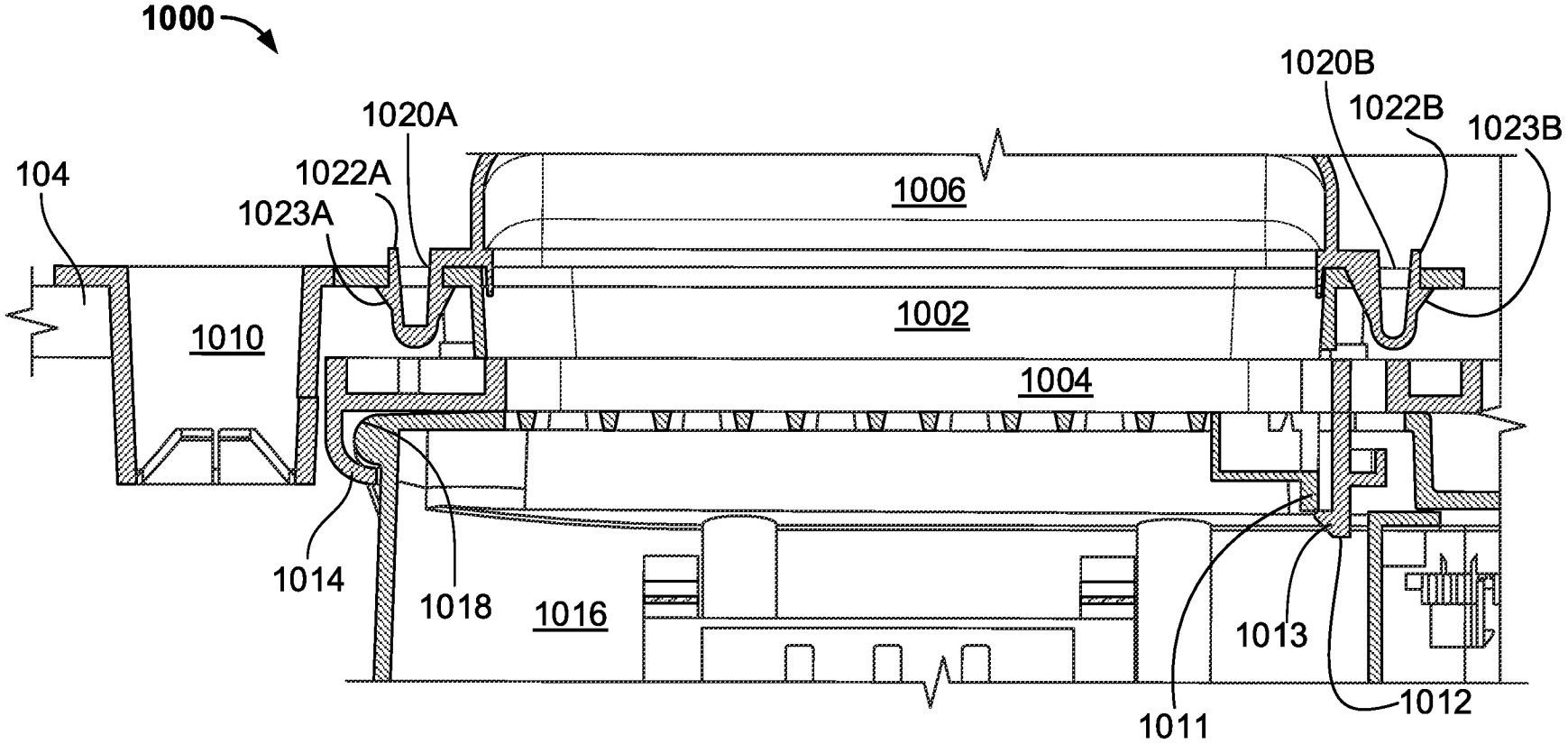

FIGS. 9A-B are cross-sectional side views of another example modular air controller 1000 (also referred to as a thermal engine) as attached to the foundation 104. FIG. 9A further depicts a plenum 1006 configured to be coupled to an air duct hose extending from the mattress (e.g., the air distribution layer 122). Similar to the thermal engine 120 described herein, the thermal engine 1000 is attached to the foundation 104 using a toolless connection interface. In some implementations, the toolless connection interface includes a first attachment plate 1002 and a second attachment plate 1004. The first attachment plate 1002 can be attached to one side of the foundation 104 (e.g., the top surface of the foundation 104), and the second attachment plate 1004 can be attached to the opposite side of the foundation 104 (e.g., the bottom surface of the foundation 104). The first and second attachment plates 1002 and 1004 can be coupled to each other so that the first and second attachment plates 1002 and 1004 are secured to the foundation 104. The first and second attachment plates 1002 and 1004 can be coupled to each other in various methods, such as by interference fitting (e.g., via connectors 1032A-N and corresponding receivers 1030A-N, described below with reference to FIGS. 11A-B), by fasteners (e.g., screws), or other suitable coupling mechanisms.

The first attachment plate 1002 has a structure that removably couples the plenum 1006 at the top of the foundation 104. The second attachment plate 1004 has a structure that removably couples the thermal module 1000 at the bottom of the foundation 104. For example, the thermal module 1000 has a case 1016 that can be removably engaged (e.g., snapped) to the second attachment plate 1004, as further described below. The case 1016 of the thermal module 1000 can house one or more components of the thermal engine 1000, as described herein (e.g., a fan).

In some implementations, as depicted in FIG. 9A, the plenum 1006 can snap onto the first attachment plate 1002. The case 1016 is attached to the second attachment plate 1004. The toolless connection interface in this example can provide various advantages because the first and second attachment plates 1002 and 1004 are separately provided and engaged at the opposite sides of the foundation 104, respectively. For example, the first and second attachment plates 1002 and 1004 can be secured to various foundations having different thicknesses, without modifications or adaptations to such different foundations. This is because the first and second attachment plates 1002 and 1004 can simply be placed at the opposite sides of the foundation 104 and coupled to each other through an opening defined through the thickness of the foundations.

In some implementations, to first attachment plate 1002 includes a retaining cup 1010. The retaining cup 1010 can hold wires, as described above in reference to the retaining cup 210.

Figure 11A:
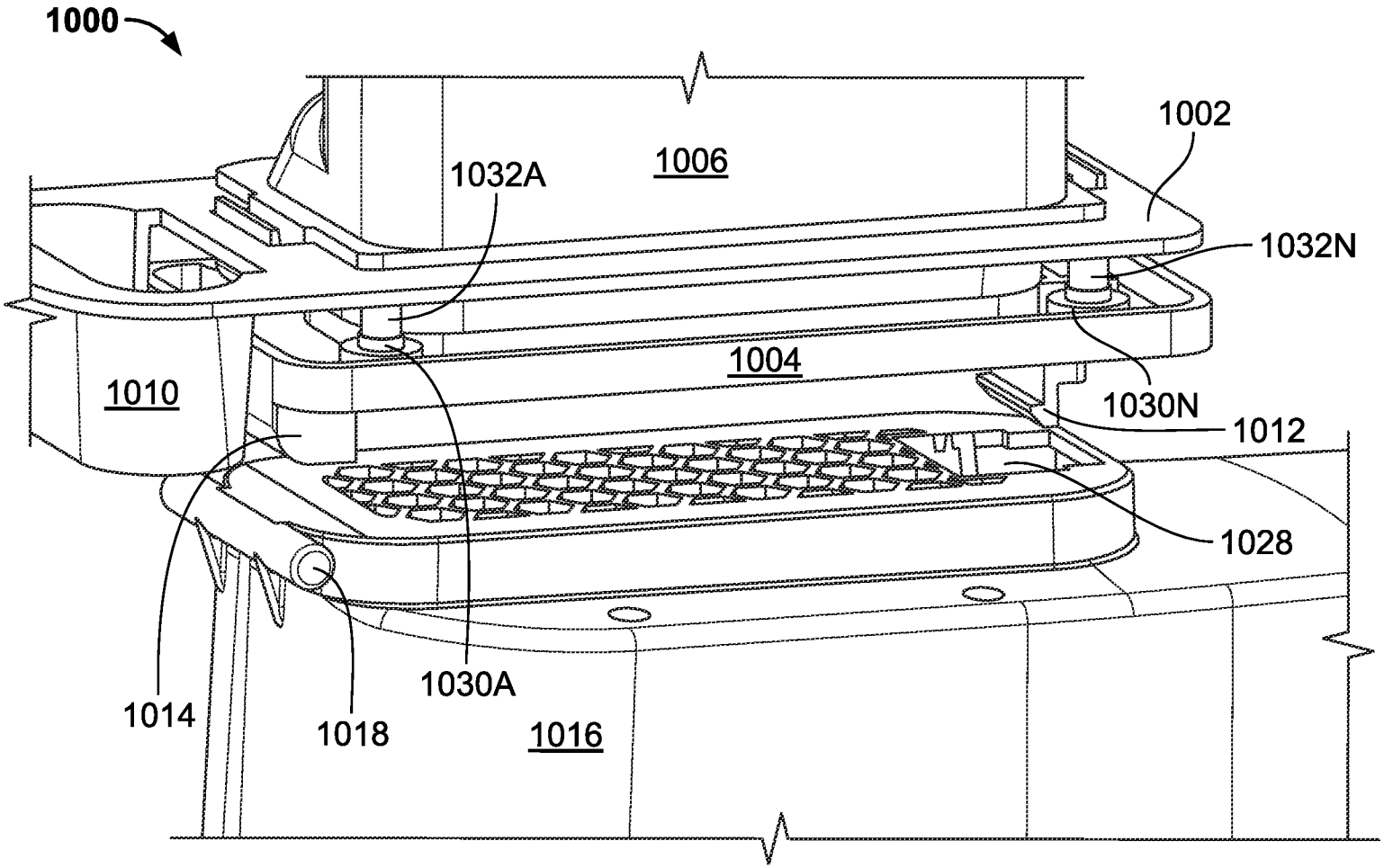
FIG. 11A is a perspective view of the modular air controller of FIGS. 9A-B.

Similarly to the attachment plate 200, the second attachment plate 1004 provides a toolless interface for removably coupling the thermal engine 1000. For example, the attachment plate 1004 includes a locking tab 1012, which is structurally and functionally similar to the locking tab 220 of the attachment plate 200. Similarly to the snapping end 218 in the attachment plate 200, the locking tab 1012 of the second attachment plate 1002 includes a snapping end 1013. The locking tab 1012 (with the snapping end 1013) is configured to engage with and disengaged from an engagement portion 1011 of the case 1016 in a manner similar to the locking tab 220 (with the snapping end 218) being engaged with the engagement portion 219 of the case 202. For example, once the locking tab 1012 is snapped into place and engages with the engagement portion 1011 of the case 1016, the case 1016 of the thermal engine 1000 can be retained to the second attachment plate 1004. More details of this coupling mechanism is described above with respect to the locking tab 220 of the attachment plate 200. As illustrated in FIG. 11A, the case 1016 can include an opening 1028 that receives the locking tab 1012 therethrough.

In some implementations, unlike the attachment plate 200, the second attachment plate 1004 includes a receiving cup (an example of a coupling receiver) 1014, instead of the slit 218 of the attachment plate 200. The receiving cup 1014 is configured to receive a pivot bar (an example of a coupling protrusion) 1018 of the case 1016. The receiving cup 1014 can be used to secure the second attachment plate 1004 to the case 1016 by engaging the pivot bar 1018 of the case 1016.

Accordingly, to retain the first and second attachment plates 1002 and 1004 to the case 1016, the receiving cup 1014 can be snapped or otherwise fitted around the pivot bar 1018 while the locking tab 1012 can be inserted into an opening in the case 1016 (e.g., the opening 1028 in FIG. 11A) and retained by the engagement portion 1011 of the case 1016. The receiving cup 1014 can be made of a flexible material that allows for easier and simpler engagement and disengagement of the second attachment plate 1004 from the case 1016. To remove the first and second attachment plates 1002 and 1004 from the case 1016, a tool (e.g., a blunt butter knife, a flathead screw driver, or any suitable tool or item having an extended tip) can be used to disengage the locking tab 1012 (e.g., the snapping end 1013 thereof) from the engagement portion 1011 of the case 1016, as described above. The pivot bar 1018 can then be separated (e.g., removed) from the receiving cup 1014 in order to fully separate the first and second attachment plates 1002 and 1004 from the case 1016.

In other implementations, a tool may not be required to separate the first and second attachment plates 1002 and 1004 from the case 1016. For example, the receiving cup 1014 can be made of a material having relatively higher flexibility so that it can flex out and away from the case 1016 (e.g., as the pivot bar 1018 is slid out or pulled out from the receiving cup 1014), thereby removing the pivot bar 1018 from being retained in the receiving cup 1014. As a result, a tool may not be required to flex out and remove the locking tab 1012 from the engagement portion 1011 of the case 1016. Instead, by simply pulling the case 1016 away from the second attachment plate 1004, the pivot bar 1018 can be removed from the receiving cup 1014, and the locking tab 1012 can be disengaged from the engagement portion 1011 of the case 1016, thereby making it easier, simpler, and faster for a user to remove the case 1016 and/or the thermal engine 1000 from the foundation 104.

FIG. 9B is another cross-sectional side view of the thermal engine 1000. Here, the plenum 1006 is shown with engagement tabs 1022A and 1022B on respective ends of the plenum 1006. The engagement tabs 1022A and 1022B can snap into openings 1020A and 1020B of the first attachment plate 1002. In some implementations, the engagement tabs 1022A and 1022B include flanges 1023A and 1023B that are configured to each engage with portions of the first attachment plate 1002 adjacent the openings 1020A and 1020B when the engagement tabs 1022A and 1022B are inserted and snapped into the openings 1020A and 1020B. Once engaged with the portions of the first attachment plate 1002, the flanges 1023A and 1023B function to restrict the engagement tabs 1022A and 1022B from sliding out from the openings 1020A and 1020B. To remove the plenum 1006 from the first attachment plate 1002, a portion of each of the engagement tabs 1022A and 1022B can be flexed away so that the flanges 1023A and 1023B are disengaged from the portions of the first attachment plate 1002, and then the engagement tabs 1022A and 1022B can be removed from the openings 1020A and 1020B of the first attachment plate 1002. This can be manually performed by a user or technician, for example by pressing or squeezing the engagement tabs 1022A and 1022B with thumbs and fingers.

In other implementations, a tool can be used to bend or flex the engagement tabs 1022A and 1022B towards the plenum 1006 to disengage an engagement portion (e.g., the flanges 1023A and 1023B) of each of the engagement tabs 1022A and 1022B from the respective openings 1020A and 1020B. In some implementations, a tool may not be required, and instead, a user can flex the engagement tabs 1022A and 1022B with their fingers to release the tabs 1022A and 1022B from the openings 1020A and 1020B. The user can then lift the plenum 1006 up to fully disengage the plenum 1006 from the first attachment plate 1002.

Figure 10:
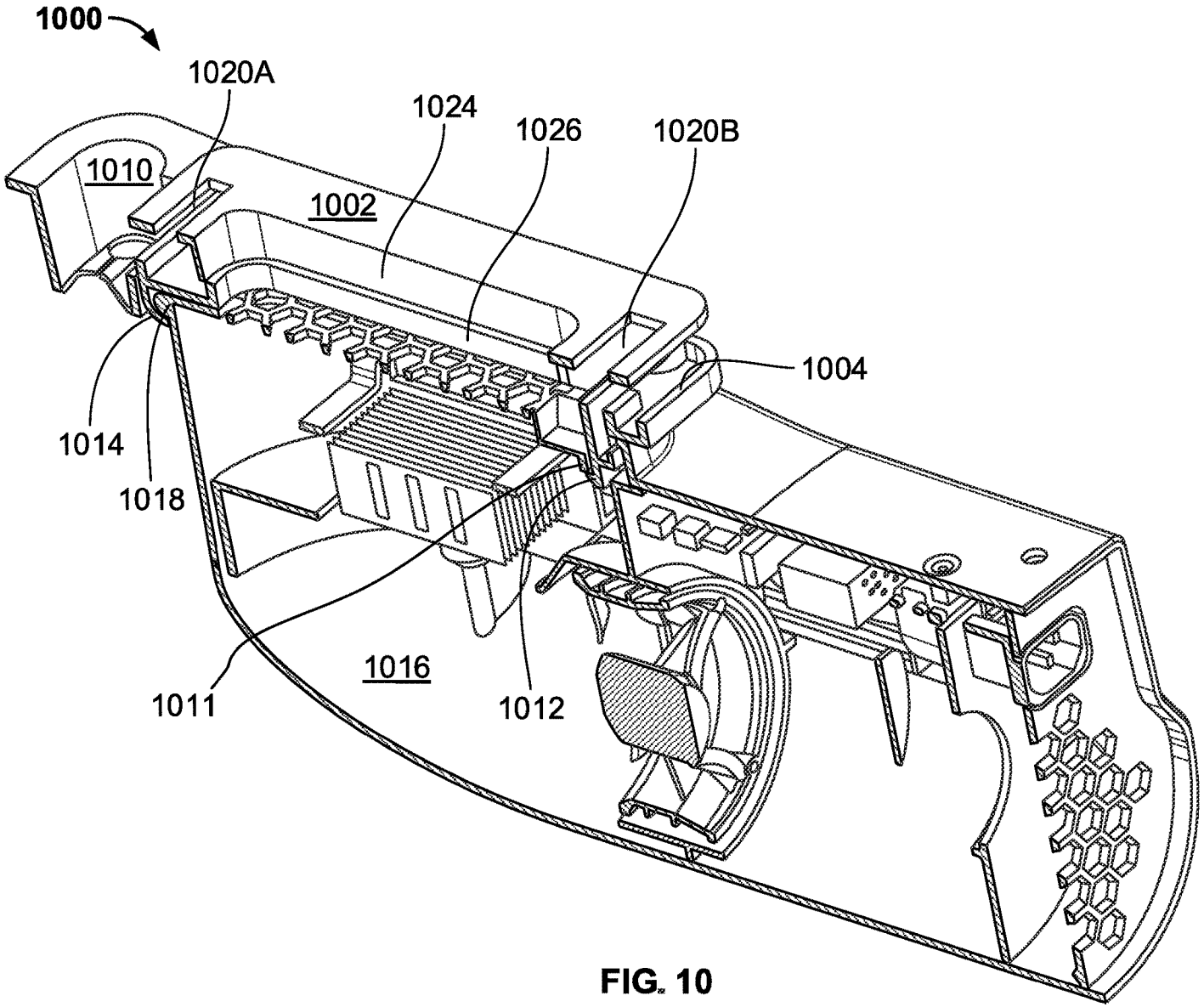
FIG. 10 is a perspective cross-sectional view of the modular air controller of FIGS. 9A-B.

FIG. 10 is a perspective cross-sectional view of the modular air controller 1000 of FIGS. 9A-B. As shown, the first attachment plate 1002 defines an opening 1024 that lines up with an opening 1026 of the second attachment plate 1004. The openings 1024 and 1026 can be same or similar sizes in order to provide a desired amount of airflow from the case 1016 into the bed system through a plenum (e.g., the plenum 1006) and an air duct hose connected between the plenum and the bed system.

As described above, to remove the thermal engine 1000 from the foundation, a tool (e.g., blunt butter knife) can be inserted into the opening 1020B and used to disengage the locking tab 1012 from the engagement portion 1011 of the case 1016 of the thermal engine 1000. Once the locking tab 1012 is released from the engagement portion 1011 of the case 1016, the pivot bar 1018 of the case 1016 can be removed from the receiving cup 1014 of the second attachment plate 1004.

FIG. 11A is a perspective view of the modular air controller 1000 of FIGS. 9A-B. In this Figure, the foundation 104 is removed while the first and second attachment plates 1002 and 1004 are coupled to each other. The first attachment plate 1002 can include engagement connectors 1032A-N (e.g., protrusions, columns, or other longitudinal shapes) that engage with receivers 1030A-N (e.g., holes, channels, hollows, etc.) of the second attachment plate 1004. The engagement connectors 1032A-N can be positioned at the first attachment plate 1002 to align with the receivers 1030A-N of the second attachment plate 1004. In some implementations, the engagement connectors 1032A-N and the receivers 1030A-N can be configured at each corner of the first and second attachment plates 1002 and 1004, respectively. In some implementations, the engagement connectors 1032A-N and the receivers 1030A-N can be located at different positions along perimeters of the first and second attachment plates 1002 and 1004. In some implementations, the engagement connectors 1032A-N can be configured to interference fit with the receivers 1030A-N. Thus, when the engagement connectors 1032A-N are inserted into the receivers 1030A-N, the first attachment plate 1002 can be coupled to the second attachment plate 1004. Thus, a user, installer, or technician can easily and quickly align the engagement connectors 1032A-N with the receivers 1030A-N and snap the first and second attachment plates 1002 and 1004 together by fitting the aligned engagement connectors 1032A-N into the receivers 1030A-N.

In some implementations, the engagement connectors 1032A-N can be plastic tube-like connectors or protrusions of the first attachment plate 1002. The engagement connectors 1032A-N can also be screws, bolts, or other similar fastening mechanisms that can be received by the receivers 1030A-N and configured to retain the first attachment plate 1002 to the second attachment plate 1004. To detach the first attachment plate 1002 from the second attachment plate 1004, the user can simply pry the engagement connectors 1032A-N out of the receivers 1030A-N, without a tool, by pulling the first attachment plate 1002 in a direction opposite the second attachment plate 1004. In other implementations, the engagement connectors 1032A-N and the receivers 1030A-N can be configured to receive fastening elements (e.g., screws) that can fasten the engagement connectors 1032A-N with the receivers 1030A-N.

Figure 11B:
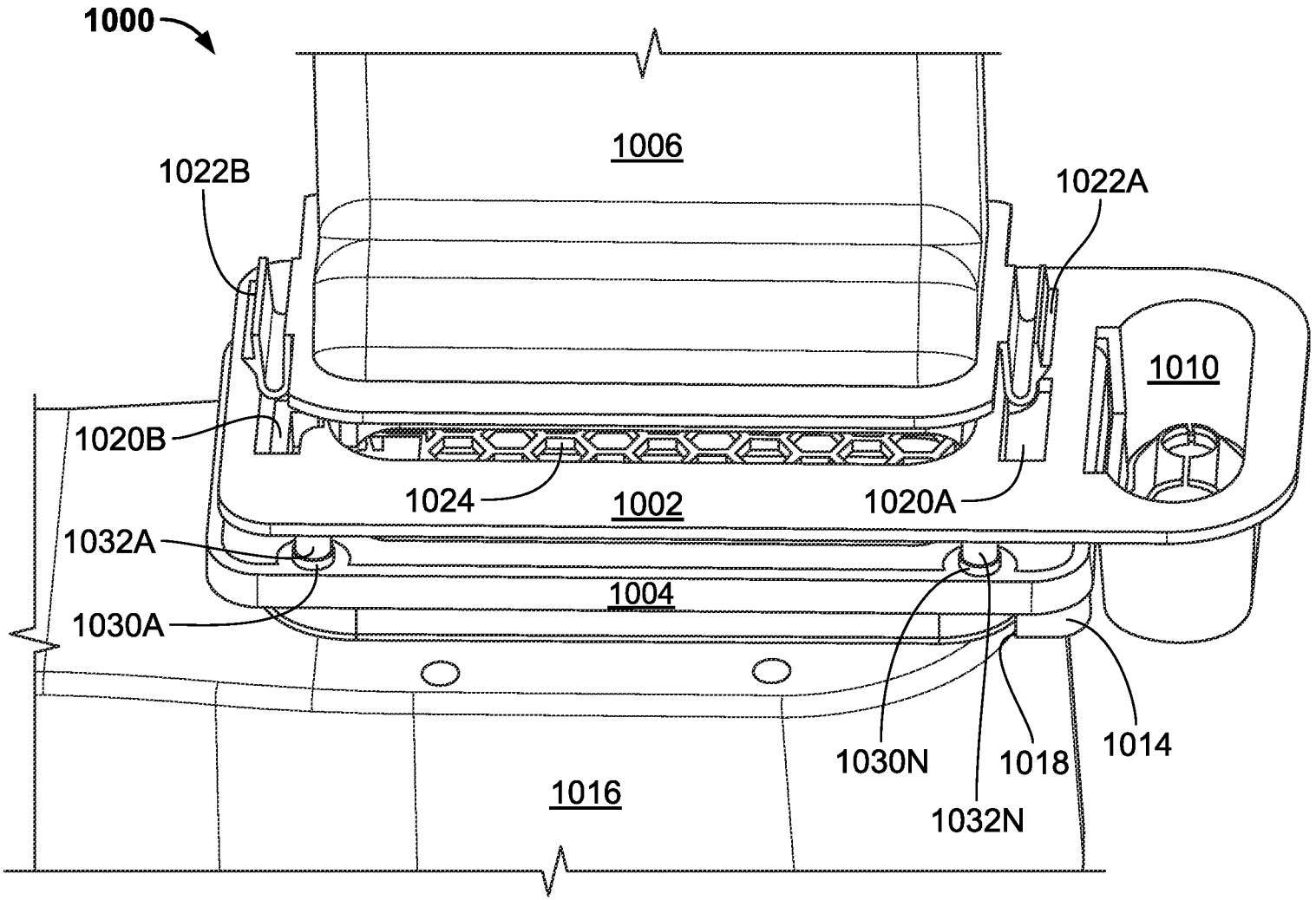
FIG. 11B is another perspective view of the modular air controller of FIGS. 9A-B.

FIG. 11B is another perspective view of the modular air controller 1000 of FIGS. 9A-B. As depicted, the first attachment plate 1002 connects to the second attachment plate 1004 via the engagement connectors 1032A-N and the receivers 1030A-N. The engagement tabs 1022A and 1022B of the plenum 1006 also snap and fit into the openings 1020A and 1020B of the first attachment plate 1002. When the plenum 1006 is retained to the first attachment plate 1002, air from components housed in the case 1016 can flow up through the opening 1024 of the first attachment plate 1002 and into the plenum 1006 to be delivered through a hose that circulate the air throughout the bed system. Alternatively, the thermal engine 1000 can operate to flow air in the opposite direction where air is drawn from the bed system through the hose, the plenum and into the case 1016 of the thermal engine 1000.

While this specification contains many specific implementation details, these should not be construed as limitations on the scope of the disclosed technology or of what may be claimed, but rather as descriptions of features that may be specific to particular embodiments of particular disclosed technologies. Certain features that are described in this specification in the context of separate embodiments can also be implemented in combination in a single embodiment in part or in whole. Conversely, various features that are described in the context of a single embodiment can also be implemented in multiple embodiments separately or in any suitable subcombination. Moreover, although features may be described herein as acting in certain combinations and/or initially claimed as such, one or more features from a claimed combination can in some cases be excised from the combination, and the claimed combination may be directed to a subcombination or variation of a subcombination. Similarly, while operations may be described in a particular order, this should not be understood as requiring that such operations be performed in the particular order or in sequential order, or that all operations be performed, to achieve desirable results. Particular embodiments of the subject matter have been described. Other embodiments are within the scope of the following claims.

What is claimed is:

1. A bed system comprising:

a foundation having a first foundation side and a second foundation side, the foundation having a support surface that is configured to support a mattress on the first foundation side and defining a foundation aperture extending between the first foundation side and the second foundation side;

an air controller having an outlet, the air controller configured to cause air to flow out of the air controller through the outlet; and a controller retainer that is fixed to the foundation proximate to the foundation aperture, wherein the controller retainer includes a connection interface at the second foundation side and configured to detachably couple with the air controller at the second foundation side, the connection interface comprising a first portion and a locking tab at a second portion of the controller retainer, the locking tab extending away from the second foundation side and including a snapping end that is configured to engage with an engagement portion of the air controller to thereby couple the air controller to the controller retainer, and wherein the controller retainer is configured to, based on the air controller being coupled to the controller retainer, align the outlet of the air controller with the foundation aperture to direct air from the air controller through the foundation aperture to the mattress positioned on the support surface of the foundation.

2. The bed system of claim 1, wherein the air controller includes an engagement flange, and wherein the connection interface includes a slit defined at the first portion of the controller retainer and configured to receive the engagement flange of the air controller to thereby couple the air controller to the controller retainer.

3. The bed system of claim 2, wherein the air controller defines an air vent through which air flows into or out of the air controller, and wherein the engagement flange of the air controller extends away from the air vent.

4. The bed system of claim 1, wherein the locking tab is configured to engage with a tool, and wherein the locking tab is configured to, based on the tool being engaged with the locking tab, flex to thereby disengage the snapping end of the locking tab from the engagement portion of the air controller.

5. The bed system of claim 1, wherein the first portion of the controller retainer is located to be opposite to the second portion of the controller retainer relative to an opening of the controller retainer.

6. The bed system of claim 1, wherein the air controller defines a housing and wherein the controller retainer is configured to detachably couple with the housing of the air controller at the second foundation side.

7. The bed system of claim 1, wherein the controller retainer defines an opening that is aligned with the foundation aperture and configured to, based on the air controller being coupled to the controller retainer, be in fluid communication with the air controller.

8. The bed system of claim 1, wherein the connection interface is at least partially exposed at a second foundation side and configured to detachably couple with the air controller at the second foundation side, and wherein the locking tab is configured to extend away from the second foundation side.

9. A method for assembling a bed, the method comprising:

fixing a controller retainer to a foundation; and coupling an air controller to the controller retainer at a lower side of the foundation by:

inserting an engagement flange of the air controller into a slit of the controller retainer in a first direction, and based on the engagement flange of the air controller being inserted in the slit of the controller retainer, engaging a locking tab of the controller retainer with an engagement portion of the air controller.

10. The method of claim 9, wherein fixing the air controller to the foundation comprises:

fixing the controller retainer at an upper side of the foundation.

11. The method of claim 10, wherein engaging the locking tab of the controller retainer with the engagement portion of the air controller comprises:

based on the engagement flange of the air controller being inserted in the slit of the controller retainer, moving the air controller toward the controller retainer until a snapping end of the locking tab engages with the engagement portion of the air controller.

12. The method of claim 10, wherein engaging the locking tab of the controller retainer with the engagement portion of the air controller comprises:

based on the engagement flange of the air controller being inserted in the slit of the controller retainer, moving the controller retainer toward the air controller until a snapping end of the locking tab engages with the engagement portion of the air controller.

13. The method of claim 9, further comprising:

positioning a mattress at an upper side of the foundation; and coupling an air duct to the controller retainer at the upper side of the foundation, the air duct extending from an air distribution layer of the mattress.

14. The method of claim 9, wherein the first direction is perpendicular to a second direction, the first direction is parallel with the lower side of the foundation, and the second direction is perpendicular to the lower side of the foundation.

15. The method of claim 14, further comprising:

flexing the locking tab of the controller retainer by engaging a tool between the locking tab of the controller retainer and the engagement portion of the air controller;

moving the air controller away from the controller retainer in a third direction until a snapping end of the flexed locking tab disengages from the engagement portion of the air controller, the third direction being opposite the second direction; and removing the engagement flange of the air controller from the slit of the controller retainer in a fourth direction, the fourth direction being opposite the first direction.

16. The method of claim 14, further comprising:

flexing the locking tab of the controller retainer by engaging a tool between the locking tab of the controller retainer and the engagement portion of the air controller;

moving the controller retainer away from the air controller in a third direction until a snapping end of the flexed locking tab disengages from the engagement portion of the air controller, the third direction being opposite the second direction; and removing the engagement flange of the air controller from the slit of the controller retainer in a fourth direction, the fourth direction being opposite the first direction.

17. A bed air controller retainer configured to attach an air controller at a foundation, comprising:

a retainer body configured to be fixed at a first foundation side of the foundation and defining an opening that is configured to be aligned with a foundation aperture being defined at the foundation;

a connection interface configured to detachably couple with the air controller at a bottom of the retainer body, the connection interface including:

a slit defined at a first portion of the retainer body and configured to receive an engagement flange of the air controller; and a locking tab at a second portion of the retainer body, the locking tab extending away from the bottom of the retainer body and including a snapping end that is configured to engage with an engagement portion of the air controller to thereby couple the air controller to the bed air controller retainer.

18. The bed air controller retainer of claim 17, wherein the locking tab is configured to engage with a tool, and wherein the locking tab is configured to, based on the tool being engaged with the locking tab, flex to thereby disengage the snapping end of the locking tab from the engagement portion of the air controller.

19. The bed air controller retainer of claim 17, wherein the first portion of the bed air controller retainer is located to be opposite to the second portion of the bed air controller retainer relative to the opening of the bed air controller retainer.

20. The bed air controller retainer of claim 17, wherein the connection interface is at least partially exposed at a second foundation side and configured to detachably couple with the air controller at the second foundation side, and wherein the locking tab is configured to extend away from the second foundation side.

* * * * *